United States Patent [19]

DePasquale et al.

[11] Patent Number: 4,805,384

[45] Date of Patent: Feb. 21, 1989

[54] MAIL INSERTING AND COLLATING APPARATUS

[75] Inventors: John A. DePasquale, New York; Ivar R. Segalowitz, Great Neck; Ceasar P. Andolfi, Bellerose, all of N.Y.

[73] Assignee: J.A.D. Enterprises, Inc., New York, N.Y.

[21] Appl. No.: 106,522

[22] Filed: Oct. 9, 1987

Related U.S. Application Data

[62] Division of Ser. No. 918,578, Oct. 14, 1986, Pat. No. 4,712,359.

[51] Int. Cl.[4] ..... B65B 25/14

[52] U.S. Cl. ..... 53/569; 53/266 A

[58] Field of Search ..... 53/266 A, 569, 252, 53/460; 271/99, 132, 108

[56] References Cited

U.S. PATENT DOCUMENTS

| | | | |
|---|---|---|---|
| 3,858,381 | 1/1975 | Huber | 53/251 X |
| 3,874,654 | 4/1975 | Holt | 271/108 X |
| 4,525,986 | 7/1985 | Noll | 53/569 |
| 4,627,606 | 12/1986 | Moore | 271/132 X |

*Primary Examiner*—John Sipos

*Attorney, Agent, or Firm*—Cobrin, Feingertz & Godsberg

[57] ABSTRACT

Mail inserting and collating apparatus includes an envelope conveyor for continuously conveying envelopes along a first path; a plurality of envelope carrier mounted on the envelope conveyor and movable therewith, for holding the envelopes; an insert conveyor for continuously conveying a plurality of inserts along a second path, at least a portion of the second path running substantially parallel and adjacent to the first path; a plurality of pockets mounted on the insert conveyor and movable therewith, for holding the inserts; a rotatable kicker roller for removing a lowermost insert from a stack of inserts and moving the lowermost insert toward a pocket adjacent the stack, the kicker roller having an arcuate rubber projecting surface for engaging the lowermost insert from the stack during rotation of the kicker roller and a vacuum port extending through the kicker roller and terminating in the projecting surface; a drive for intermittently rotating the kicker roller; a vacuum supply for supplying a vacuum to the vacuum port such that the combination of the vacuum and the rubber-like projecting surface results in removal of the lowermost insert from the stack; a cam arrangement for moving each envelope carrier toward a pocket at an insert and envelope merge station; a pocket adjustment assembly for changing the length of each pocket at the insert and envelope merge station; and each envelope carrier including a first finger for holding an envelope thereon, and a second finger for holding the envelope and inserts therein at the insert and envelope merge station.

8 Claims, 26 Drawing Sheets

20
22
22a
23
23a
23b
23c
24
25
27
108
108a
108b
108c
108i
108j
134
136
138
140
166
32
206
208
214
246
276
278
280
282
284
302

20
22
26
30
32
34
108
128
130
132
196
204
206
208
210
212
214
274
284
286
#1
#2
#3
#4
#5
#6
#7
#8
#9
#10
#11
#12
16

22
24
26
28
108
206
208
212
280
282
284
286
300
302

108d
108a
108b
134
138
140
136
108
108f
122
208
118
124
120
116
242
244
244
248
246
234
260
232
252
272
222
222
220
238
240
220
214
216
230
224

MAIL INSERTING AND COLLATING APPARATUS

This is a division of application Ser. No. 06/918,578, filed 10/14/86 now U.S. Pat. No. 4,712,359.

BACKGROUND OF THE INVENTION

The present invention relates generally to assembling apparatus, and more particularly, is directed to an apparatus for inserting and collating mailing inserts into envelopes.

In instances where a plurality of different mailing inserts are to be inserted into envelopes, it becomes impractical to manually stuff the inserts into the envelopes. Accordingly, apparatus have been developed which automatically stuff the mailing inserts into the envelopes.

One example of such known apparatus is described in U.S. Pat. No. 4,525,986 to Noll. In this apparatus, two parallel conveyors are provided, one for the envelopes to be filled and the other for the mailing inserts that are to be inserted into the envelopes. The conveyors are continuously moving such that the inserts are inserted into the envelopes while both are in motion.

As the envelopes move along the conveyor, each envelope is individually grasped at a side edge thereof by a clamping finger, which releases the envelopes temporarily at the envelope insertion station. The inserts are deposited on the insert conveyor, and at the envelope insertion station, three pusher fingers are moved toward the respective envelope. Accordingly, the inserts are engaged by notches in the pusher fingers and pushed into the envelope, whereupon the clamping finger once again clamps the side edge of the envelope.

At the envelope insertion station, in order to ensure continued movement of the envelopes at the same speed, a flap conveyor is provided which frictionally engages the flaps of the envelopes. The flap conveyor is a separate conveyor positioned inwardly of the envelope conveyor. However, this requires an additional conveyor. Also, the minor frictional engagement by the flap conveyor may vary, for example, due to the forces on the envelopes when the mailing inserts are inserted in the envelopes.

In order to ensure that the inserts are laterally aligned, the insert conveyor is provided with spaced linear bearings, and a brushback is provided to line up the inserts with the respective linear bearings. However, due to vibrations and the like, the inserts may still move laterally and be offset with respect to the envelopes. Also, it is difficult to make adjustments for different size inserts and envelopes with this arrangement.

To assure that the envelopes are opened sufficiently to receive the mailing inserts as the envelopes move to the envelope insertion station, a plurality of spring fingers are provided at the envelope insertion station. The spring fingers each include a curved portion which is inserted into the envelope at the envelope insertion station to open the same, and also to guide the inserts into the envelope thereat. However, a plurality of spring fingers are required, each secured to still another conveyor chain, thereby further complicating the apparatus.

Other mail inserting or similar apparatus are disclosed in U.S. Pat. Nos. 1,866,452; 1,960,959; 2,865,155; 3,015,926; 3,481,595; 3,858,381; 3,965,644; 3,974,623; 4,079,576; 4,156,336; 4,169,341; and 4,462,199.

In U.S. Pat. No. 3,858,381 to Huber et al., the envelope is carried by a conveyor, and the envelope is caused to converge on the inserts which travel along another conveyor. In another embodiment, the reverse is true, that is, the inserts converge on the envelopes. In both embodiments, just prior to the insertion operation, pneumatic discharge means directs a pulse of air to the respective envelope to open the same. Then, the envelope and inserts are moved so that the inserts are received in the envelopes.

In this latter U.S. Patent, in order to remove an envelope from a stack of envelopes, a roller is provided to frictionally engage the lowermost envelope of the stack, and thereby withdraw such envelope from the stack and direct it to the envelope conveyor. Alternatively, as disclosed, the roller may comprise a conventional vacuum roller or other vacuum pick-off device employing suction pressure to withdraw successive envelopes from the stack.

The inserts are removed with a similar roller. More particularly, the roller for removing the lowermost insert from a stack of inserts comprises a conventional vacuum roller including a plurality of apertures disposed about the periphery thereof, which apertures function as vacuum nozzles to exert suction pressure on successive inserts to permit the sequential withdrawal of inserts from the stack and to retain each withdrawn insert on the roller under the influence of suction pressure.

U.S. Pat. No. 1,960,959 to Sague discloses an inserting and mailing machine that operates intermittently. Accordingly, the speed of the machine is greatly reduced in comparison to the apparatus, for example, of the aforementioned U.S. Pat. No. 4,525,986 to Noll. U.S. Pat. No. 1,960,959 also discloses means for checking if the filled envelope contains the proper number of inserts. This is accomplished by measuring the thickness of the filled envelope. If an error is detected, however, the entire machine is stopped so that the error can be corrected.

In U.S. Pat. No. 3,965,644, a roller/arm sensor checks for "doubles" or "misses" of inserts as they are dropped onto a raised surface. If there is a "double" or "miss", an electrical signal is sent to a monitoring device which shuts down the entire apparatus.

OBJECTS AND SUMMARY OF THE INVENTION

Accordingly, it is an object of the present invention to provide a mail inserting and collating apparatus that overcomes the above-described deficiencies in known apparatus.

It is another object of the present invention to provide a mail inserting and collating apparatus in which each envelope is firmly held during travel to and at the insert and envelope merge station, and thereafter, the envelope and mail inserts therein are firmly held.

It is still another object of the present invention to provide a mail inserting and collating apparatus in which a first finger firmly holds each envelope during travel to and at the insert and envelope merge station, and thereafter, a second finger firmly holds the envelope and mail inserts therein.

It is yet another object of the present invention to provide a mail inserting and collating apparatus which easily and readily compensates for different size inserts.

It is a further object of the present invention to provide a mail inserting and collating apparatus having a plurality of pockets for receiving mailing inserts to be inserted into envelopes.

It is still a further object of the present invention to provide a mail inserting and collating apparatus in which the length of each insert receiving pocket is shortened so as to align the inserts prior to insertion of the same into the envelopes.

It is yet a further object of the present invention to provide a mail inserting and collating apparatus having a novel kicker roller for supplying the inserts to the insert conveyor.

It is another object of the present invention to provide a mail inserting and collating apparatus having a novel vacuum shuttle plate for supplying the inserts to the insert conveyor.

It is still another object of the present invention to provide a mail inserting and collating apparatus having a novel vacuum shuttle plate for supplying the envelopes to the envelope conveyor.

It is yet another object of the present invention to provide a mail inserting and collating apparatus in which the filled envelope is turned upside down and prepared for a postage meter.

It is a further object of the present invention in which the inserts and/or envelopes can be printed on, in conjunction with the inserting and collating operations.

In accordance with an aspect of the present invention, mail inserting and collating apparatus includes envelope conveyor means for continuously conveying a plurality of envelopes along a first path; at least one envelope carrier means mounted on the envelope conveyor means and movable therewith, for holding the envelopes on the envelope conveyor means; insert conveyor means for continuously conveying a plurality of inserts along a second path, at least a portion of the second path running substantially parallel and adjacent to the first path; at least one pocket means mounted on the insert conveyor means and movable therewith, for holding the inserts on the insert conveyor means; cam means for moving each envelope carrier means toward a respective pocket means at an insert and envelope merge station; and each envelope carrier means including first finger means for holding an envelope thereon, and second finger means for holding the envelope and inserts received in the envelope at the insert and envelope merge station.

In accordance with another aspect of the present invention, mail inserting and collating apparatus includes envelope conveyor means for continuously conveying a plurality of envelopes along a first path; at least one envelope carrier means mounted on the envelope conveyor means and movable therewith, for holding the envelopes on the envelope conveyor means; insert conveyor means for continuously conveying a plurality of inserts along a second path, at least a portion of the second path running substantially parallel and adjacent to the first path; at least one pocket means mounted on the insert conveyor means and movable therewith, for holding the inserts on the insert conveyor means; cam means for moving each envelope carrier means toward a respective pocket means at an insert and envelope merge station; rotatable kicker roller means for removing a lowermost insert from a stack of inserts and moving the lowermost insert toward a respective pocket means positioned adjacent the stack, the kicker roller means having an arcuate rubber-like projecting surface for engaging the lowermost insert from the stack during rotation of the kicker roller means and a vacuum port extending through the kicker roller means and terminating in the projecting surface thereof; rotation means for intermittently rotating the kicker roller means; and vacuum means for supplying a vacuum to the vacuum port such that the combination of the vacuum and the rubber-like projecting surface results in removal of the lowermost insert from the stack.

In accordance with still another aspect of the present invention, mail inserting and collating apparatus includes envelope conveyor means for continuously conveying a plurality of envelopes along a first path; at least one envelope carrier means mounted on the envelope conveyor means and movable therewith, for holding the envelopes on the envelope conveyor means; insert conveyor means for continuously conveying a plurality of inserts along a second path, at least a portion of the second path running substantially parallel and adjacent to the first path; at least one pocket means mounted on the insert conveyor means and movable therewith, for holding the inserts on the insert conveyor means; cam means for moving each envelope carrier means toward a respective pocket means at an insert and envelope merge station; and pocket adjustment means for changing the length of each pocket means when the latter is moved to the insert and envelope merge station.

In accordance with yet another aspect of the present invention, mail inserting and collating apparatus includes envelope conveyor means for continuously conveying a plurality of envelopes along a first path; at least one envelope carrier means mounted on the envelope conveyor means and movable therewith, for holding the envelopes on the envelope conveyor means; insert conveyor means for continuously conveying a plurality of inserts along a second path, at least a portion of the second path running substantially parallel and adjacent to the first path; at least one pocket means mounted on the insert conveyor means and movable therewith, for holding the inserts on the insert conveyor means; rotatable kicker roller means for removing a lowermost insert from a stack of inserts and moving the lowermost insert toward a respective pocket means positioned adjacent the stack, the kicker roller means having an arcuate rubber-like projecting surface for engaging the lowermost insert from the stack during rotation of the kicker roller means and a vacuum port extending through the kicker roller means and terminating in the projecting surface thereof; rotation means for intermittently rotating the kicker means; vacuum means for supplying a vacuum to the vacuum port such that the combination of the vacuum and the rubber-like projecting surface results in removal of the lowermost insert from the stack; cam means for moving each envelope carrier means toward a respective pocket means at an insert and envelope merge station; pocket adjustment means for changing the length of each pocket means when the latter is moved to the insert and envelope merge station; and each envelope carrier means including first finger means for holding an envelope thereon, and second finger means for holding the envelope and inserts received in the envelope at the insert and envelope merge station.

In accordance with a further aspect of the present invention, mail inserting and collating apparatus includes envelope conveyor means for continuously conveying a plurality of envelopes along a first path; at least one envelope carrier means mounted on the envelope conveyor means and movable therewith, for holding the envelopes on the envelope conveyor means; insert conveyor means for continuously conveying a plurality of inserts along a second path, at least a portion of the second path running substantially parallel and adjacent to the first path; at least one pocket means mounted on the insert conveyor means and movable therewith, for holding the inserts on the insert conveyor means; cam means for moving each envelope carrier means toward a respective pocket means at an insert and envelope merge station; and vacuum shuttle plate means for removing a lowermost insert from a stack of inserts and moving the lowermost insert toward a respective pocket means positioned adjacent the stack, the vacuum shuttle plate means including a vacuum shuttle plate having vacuum apertures on an upper surface thereof for providing a suction to the lowermost insert from the stack; means for reciprocating the vacuum shuttle plate between a first position and a second position; and vacuum means for supplying a vacuum to the vacuum apertures of the vacuum shuttle plate when the vacuum shuttle plate is reciprocated to the first position and for removing the vacuum when the vacuum shuttle plate is reciprocated to the second position.

In accordance with a still further aspect of the present invention, mail inserting and collating apparatus includes envelope conveyor means for continuously conveying a plurality of envelopes along a first path; at least one envelope carrier means mounted on the envelope conveyor means and movable therewith, for holding the envelopes on the envelope conveyor means; insert conveyor means for continuously conveying a plurality of inserts along a second path, at least a portion of the second path running substantially parallel and adjacent to the first path; at least one pocket means mounted on the insert conveyor means and movable therewith, for holding the inserts on the insert conveyor means; cam means for moving each envelope carrier means toward a respective pocket means at an insert and envelope merge station; and vacuum shuttle plate means for removing a lowermost envelope from a stack of envelopes and moving the lowermost envelope toward the envelope conveyor means positioned adjacent the stack, the vacuum shuttle plate means including a vacuum shuttle plate having vacuum apertures on an upper surface thereof for providing a suction to the lowermost envelope from the stack; means for reciprocating the vacuum shuttle plate between a first position and a second position; and vacuum means for supplying a vacuum to the vacuum apertures of the vacuum shuttle plate when the vacuum shuttle plate is reciprocated to the first position and for removing the vacuum when the vacuum shuttle plate is reciprocated to the second position.

In accordance with a yet further aspect of the present invention, a method of inserting mailing inserts into envelopes, includes the steps of supplying the envelopes to at least one envelope carrier means for holding the envelopes; clamping each supplied envelope in a respective carrier means with first clamping finger means secured to the respective envelope carrier means; moving the envelopes clamped to the envelope carrier means means along a first path; supplying the inserts to at least one pocket means for holding the inserts; moving the inserts in the pocket means along a second path in which at least a portion of the second path runs substantially parallel and adjacent to the first path; moving each envelope carrier means toward a respective pocket means at an insert and envelope merge station to move the pocket means into the envelope; and clamping the envelope and inserts received in the envelope at the insert and envelope merge station with second clamping finger means secured to the respective envelope carrier means.

In accordance with another aspect of the present invention, a method of inserting mailing inserts into envelopes, includes the steps of supplying the envelopes to at least one envelope carrier means for holding the envelopes; moving the envelopes in the envelope carrier means along a first path; positioning rotatable kicker roller means such that an arcuate rubber-like projecting surface thereof engages a lowermost insert in a stack of inserts during at least a arcuate portion of the rotation of the kicker roller means; intermittently rotating the kicker roller means; applying a vacuum to the projecting surface such that the combination of the vacuum and the rubber-like projecting surface results in the supply of the lowermost insert from the stack to at least one pocket means for holding the inserts; moving the inserts in the pocket means along a second path in which at least a portion of the second path runs substantially parallel and adjacent to the first path; and moving each envelope carrier means toward a respective pocket means at an insert and envelope merge station to move the pocket means into the envelope.

In accordance with still another aspect of the present invention, a method of inserting mailing inserts into envelopes, includes the steps of supplying the envelopes to at least one envelope carrier means for holding the envelopes; moving the envelopes in the envelope carrier means along a first path; supplying the inserts to at least one pocket means for holding the inserts; moving the inserts in the pocket means along a second path in which at least a portion of the second path runs substantially parallel and adjacent to the first path; moving each envelope carrier means toward a respective pocket means at an insert and envelope merge station to move the pocket means into the envelope; and changing the length of each pocket means when the latter is moved to the insert and envelope merge station.

In accordance with a further aspect of the present invention, mail inserting and collating apparatus includes envelope conveyor means for continuously conveying a plurality of envelopes along a first path; at least one envelope carrier means mounted on the envelope conveyor means and movable therewith, for holding the envelopes on the envelope conveyor means; insert conveyor means for continuously conveying a plurality of inserts along a second path, at least a portion of the second path running substantially parallel and adjacent to the first path; at least one pocket means mounted on the insert conveyor means and movable therewith, for holding the inserts on the insert conveyor means; cam means for moving each envelope carrier means toward a respective pocket means at an insert and envelope merge station; and insert supply means for supplying the inserts to the conveyor means, the insert supply means including web means for supplying a roll of paper; cutter means for cutting the roll of paper into a plurality of the inserts; and feed means for feeding the inserts to the at least one pocket means.

In accordance with a still further aspect of the present invention, a method of inserting and collating mailing inserts into envelopes, includes the steps of supplying the envelopes to at least one envelope carrier means for holding the envelopes; clamping each supplied envelope in a respective carrier means with first clamping finger means secured to the respective envelope carrier means; moving the envelopes clamped to the envelope carrier means along a first path; positioning rotatable kicker roller means such that an arcuate rubber-like projecting surface thereof engages a lowermost insert in a stack of inserts during at least a arcuate portion of the rotation of the kicker roller means; intermittently rotating the kicker roller means; applying a vacuum to the projecting surface such that the combination of the vacuum and the rubber-like projecting surface results in the supply of the lowermost insert from the stack to at least one pocket means for holding the inserts; moving the inserts in the pocket means along a second path in which at least a portion of the second path runs substantially parallel and adjacent to the first path; each envelope carrier means toward a respective pocket means at an insert and envelope merge station to move the pocket means into the envelope; changing the length of each pocket means when the latter is moved to the insert and envelope merge station; and clamping the envelope and inserts received in the envelope at the insert and envelope merge station with second clamping finger means secured to the respective envelope carrier means.

In accordance with another aspect of the present invention, mail inserting and collating apparatus includes envelope conveyor means for continuously conveying a plurality of envelopes along a first path; at least one envelope carrier means mounted on the envelope conveyor means and movable therewith, for holding the envelopes on the envelope conveyor means; a plurality of insert hopper means for containing a plurality of stacks of inserts; insert conveyor means for continuously conveying a plurality of inserts along a second path, at least a portion of the second path running substantially parallel and adjacent to the first path; at least one pocket means mounted on the insert conveyor means and movable therewith, for holding the inserts on the insert conveyor means; cam means for moving each envelope carrier means toward a respective pocket means at an insert and envelope merge station; envelope carrier means including first finger means for holding an envelope thereon, and second finger means for holding the envelope and inserts received in the envelope at the insert and envelope merge station; means for removing a lowermost insert from the insert hopper means and moving the lowermost insert toward a respective pocket means positioned adjacent the stack, the means for removing including at least one vacuum port for holding the lowermost insert; vacuum means for selectively supplying a vacuum to the at least one vacuum port; pocket adjustment means for changing the length of each the pocket means when the latter is moved to the insert and envelope merge station; and at least the plurality of hopper means, the pocket means, the envelope carrier means and the means for removing being modularly constructed.

In accordance with still another aspect of the present invention, mail inserting and collating apparatus includes envelope conveyor means for continuously conveying a plurality of envelopes along a first path; at least one envelope carrier means mounted on the envelope conveyor means and movable therewith, for holding the envelopes on the envelope conveyor means; a plurality of insert hopper means for containing a plurality of stacks of inserts; insert conveyor means for continuously conveying a plurality of inserts along a second path, at least a portion of the second path running substantially parallel and adjacent to the first path; at least one pocket means mounted on the insert conveyor means and movable therewith, for holding the inserts on the insert conveyor means; removing means for selectively removing the inserts from the insert hopper means and supplying the same partially in the at least one pocket means; pusher means for pushing the inserts further into the at least one pocket means; and cam means for moving each envelope carrier means toward a respective pocket means at an insert and envelope merge station.

The above and other objects, features and advantages of the present invention will become readily apparent from the following detailed description which is to be read in connection with the accompanying drawings.

DETAILED DESCRIPTION OF THE PREFERRED EMBODIMENTS

Figure 2:
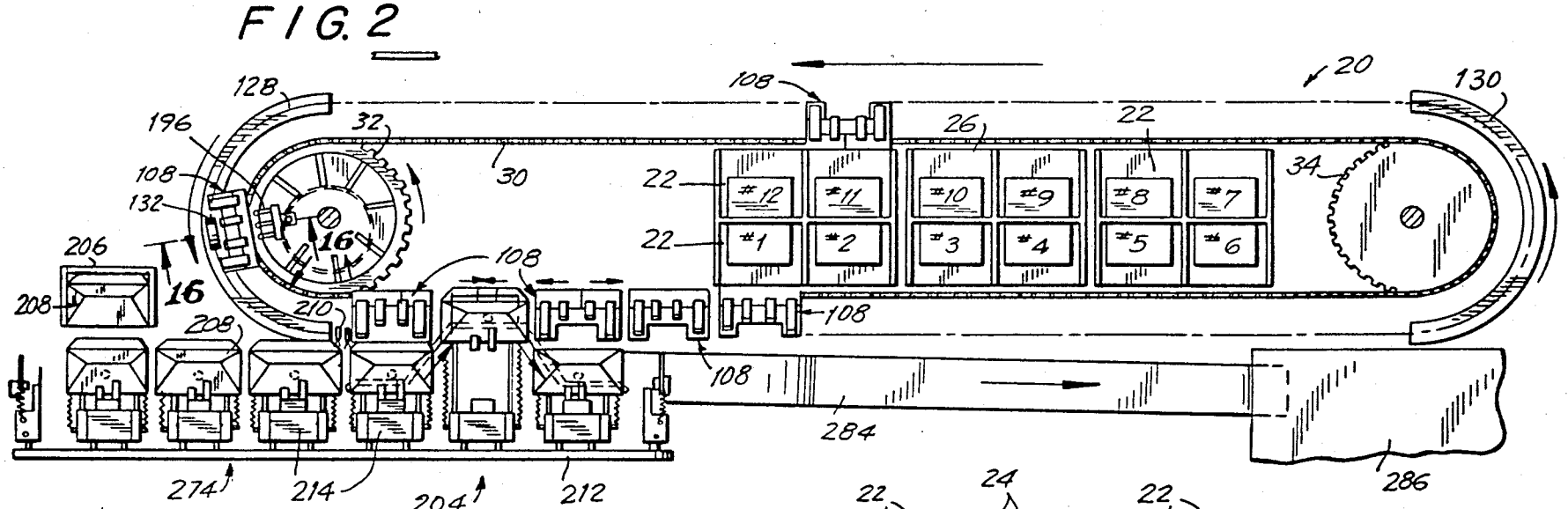
FIG. 2 is a top plan view of the mail inserting and collating apparatus of FIG. 1.
Figure 4:
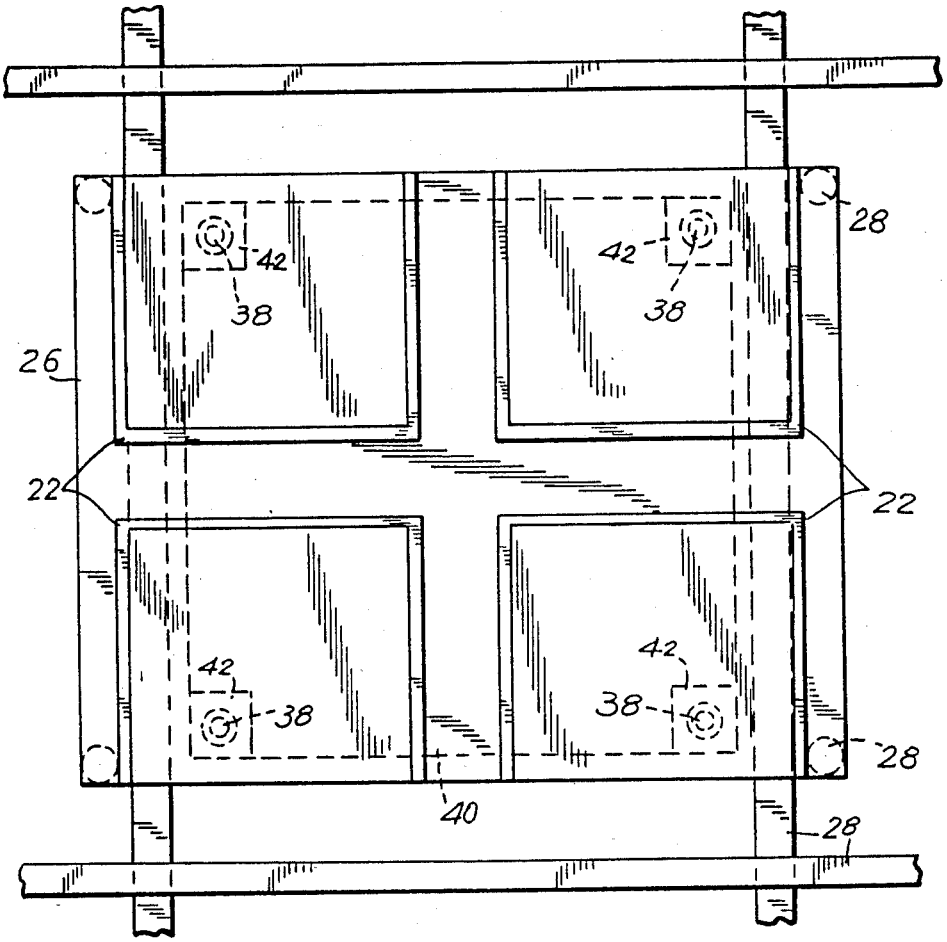
FIG. 4 is a top plan view of some of the insert hoppers of the mail inserting and collating apparatus of FIG. 2.
Figure 5:
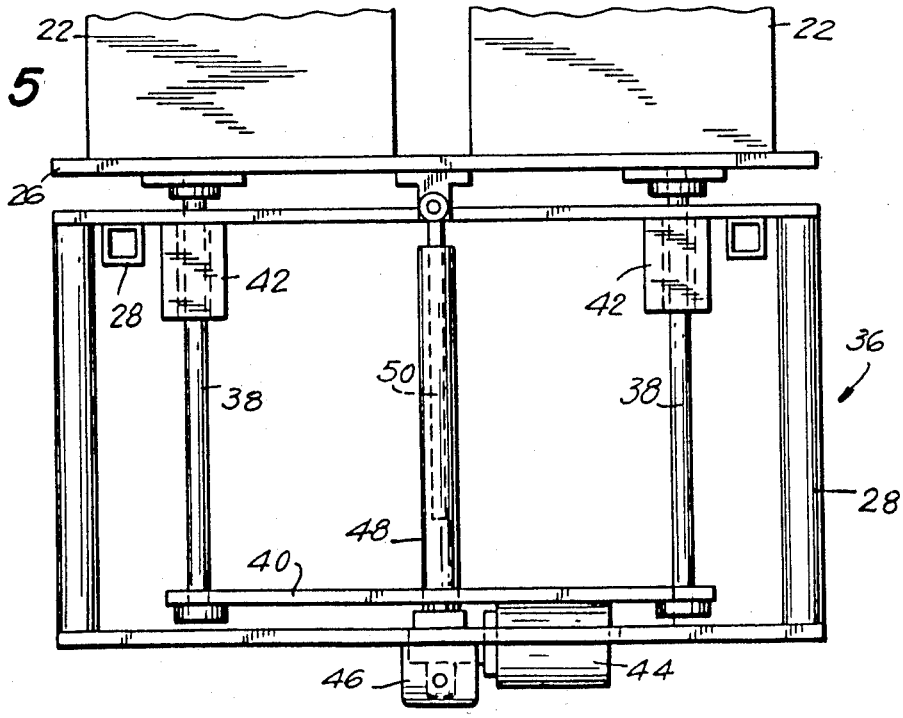
FIG. 5 is a side elevational view of the insert hoppers of FIG. 4.

Referring to the drawings in detail, a mail inserting and collating apparatus 20 according to the present invention includes a plurality of insert hoppers 22, each containing a stack of mailing inserts 24. Although twelve insert hoppers 22 are shown in the drawings, the present invention is not limited to this number, and the number of insert hoppers 22 may vary as desired. As shown in FIGS. 2, 4 and 5, insert hoppers 22 are arranged in two rows of six insert hoppers 22 on a platform 26 which, in turn, is supported on framework 28 of apparatus 20. In order to stack inserts 24 in each hopper 22 without interrupting the operation of the apparatus 20, a chute 21 is connected to the top of each insert hopper 22, as shown in FIG. 7A.

Figure 1:
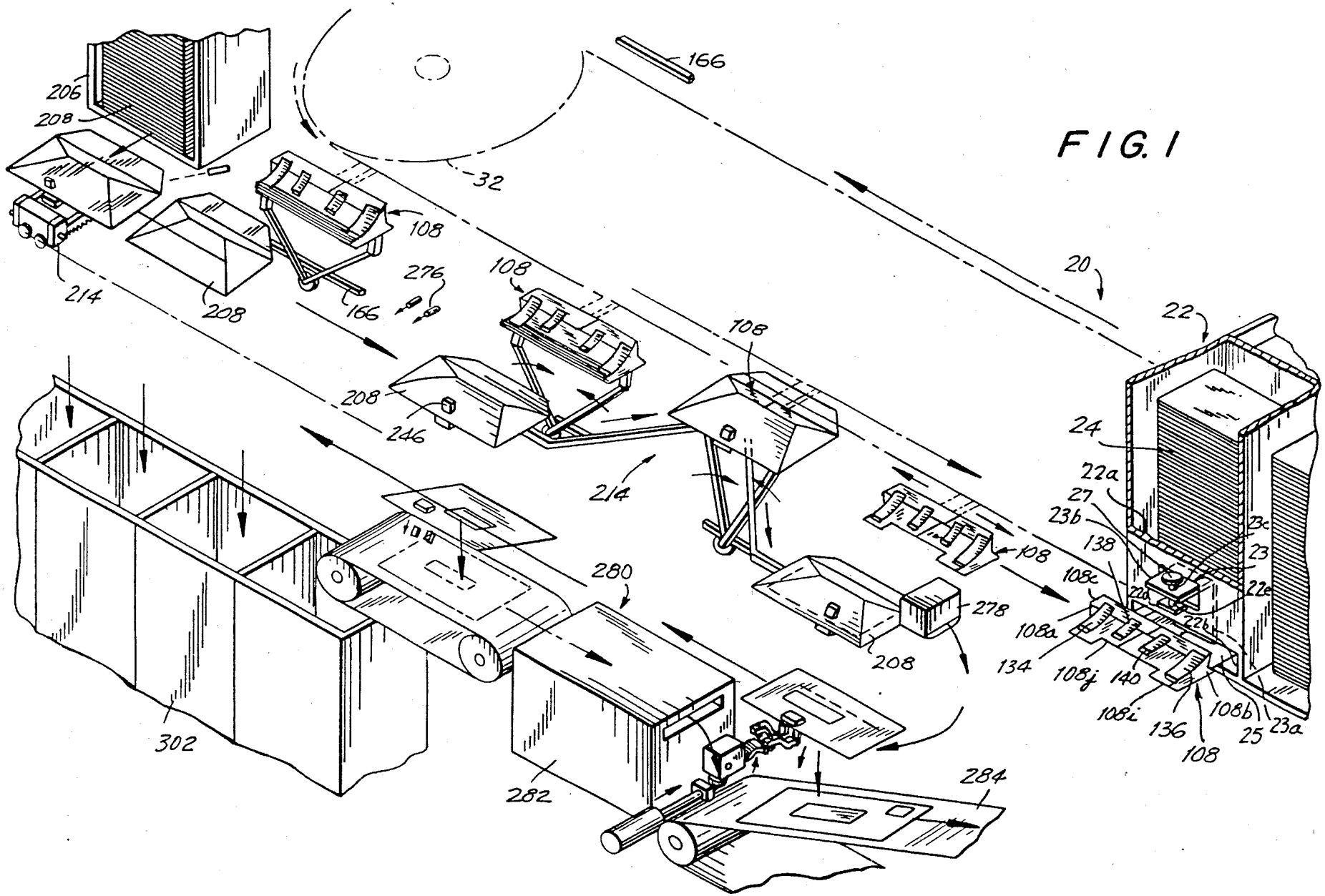
FIG. 1 is a schematic perspective view of a mail inserting and collating apparatus according to one embodiment of the present invention.

As shown in FIG. 1, the outwardly facing wall 22*a* of each insert hopper 22 is provided with a slot-like opening 22*b* at the lower end thereof, so that the mailing inserts 24 can be removed therefrom. Wall 22*a* is only shown on the leftmost hopper 22 in FIG. 1 for ease in understanding the present invention, although all insert hoppers 22 are formed with such an outwardly facing wall 22*a* and slot-like opening 22*b*. Each wall 22*a* has a gate 23 associated therewith and positioned in front of the respective opening 22*b* so as to reduce the height thereof, while still maintaining a small clearance 25 which permits a single insert 24 to be removed therethrough.

Specifically, gate 23 is formed in an L-shaped configuration, with one leg 23*a* extending vertically down in front of opening 22*b* and parallel with wall 22*a* to define the aforementioned clearance 25, and with the other leg 23*b* extending horizontally through an opening 22*c* in wall 22*a*. Leg 23*b* also includes an aperture 23*c* therein. Opening 22*c* is positioned above opening 22*b*. A projecting tab 22*d* extends outwardly from wall 22*a* immediately below opening 22*c*, projecting tab 22*d* having a screw-threaded aperture 22*e* therein. In this manner, a bolt 27 extends through aperture 23*c* of leg 23*b*, and is secured therein by any suitable means well known in the art, so as to permit free rotation of bolt 27 in aperture 23*c*, but which does not permit vertical movement of bolt 27 with respect to leg 23*b*. The free end of bolt 27 is screw-threadedly received in aperture 23*e* of tab 23*d*. In this manner, by turning bolt 27, the height of gate 23 will change, thereby changing the clearance 25.

A continuously moving, endless insert conveyor 30 in the form of a chain extends between two sprockets 32 and 34 so as to form insert conveyor 30 in an oblong configuration. Insert conveyor 30 is formed in a horizontal plane in surrounding relation to insert hoppers 22.

As shown in FIG. 5, insert hoppers 22 can be raised or lowered with respect to the upper horizontal surface of insert conveyor 30 by at least one height adjustment means 36, preferably for the purpose of removing, installing or servicing insert hoppers 22. More particularly, vertical guide rods 38 are secured at lower ends thereof to a lower support 40, and at upper ends thereof to the underside of platform 26. The number of guide rods 38 is preferably equal to the number of insert hoppers 22, such that one guide rod 38 is provided below each insert hopper 22, as shown in FIG. 4. The upper ends of guide rods 38 are also slidably guided within guide sleeves 42 secured to framework 28.

A motor 44 is secured to a lower portion of framework 28 and has an output shaft connected to a worm gear 46 which, in turn, rotates a shaft 48. Shaft 48 extends freely through lower support 40, and has a screw-threaded internal bore. A screw-threaded rod 50 is received within bore 48, and is secured at the upper end thereof to the underside of platform 26. Thus, as shaft 48 rotates, rod 50 is caused to move upwardly or downwardly with respect thereto. This results in a raising or lowering of platform 26. During such movement, guide rods 38 provide stability to platform 26. For example, with the arrangement described above, a maximum height setting of approximately ten inches can be provided with a fine adjustment at the bottom of the stroke.

With reference to FIGS. 4 and 5, the height adjustment means 36 is shown to be associated with only four insert hoppers 22. Preferably, for the twelve insert hoppers 22 of FIG. 2, three height adjustment means 36 are provided. In this regard, platform 26 is divided into three sections, as shown in FIG. 2.

Figure 7:
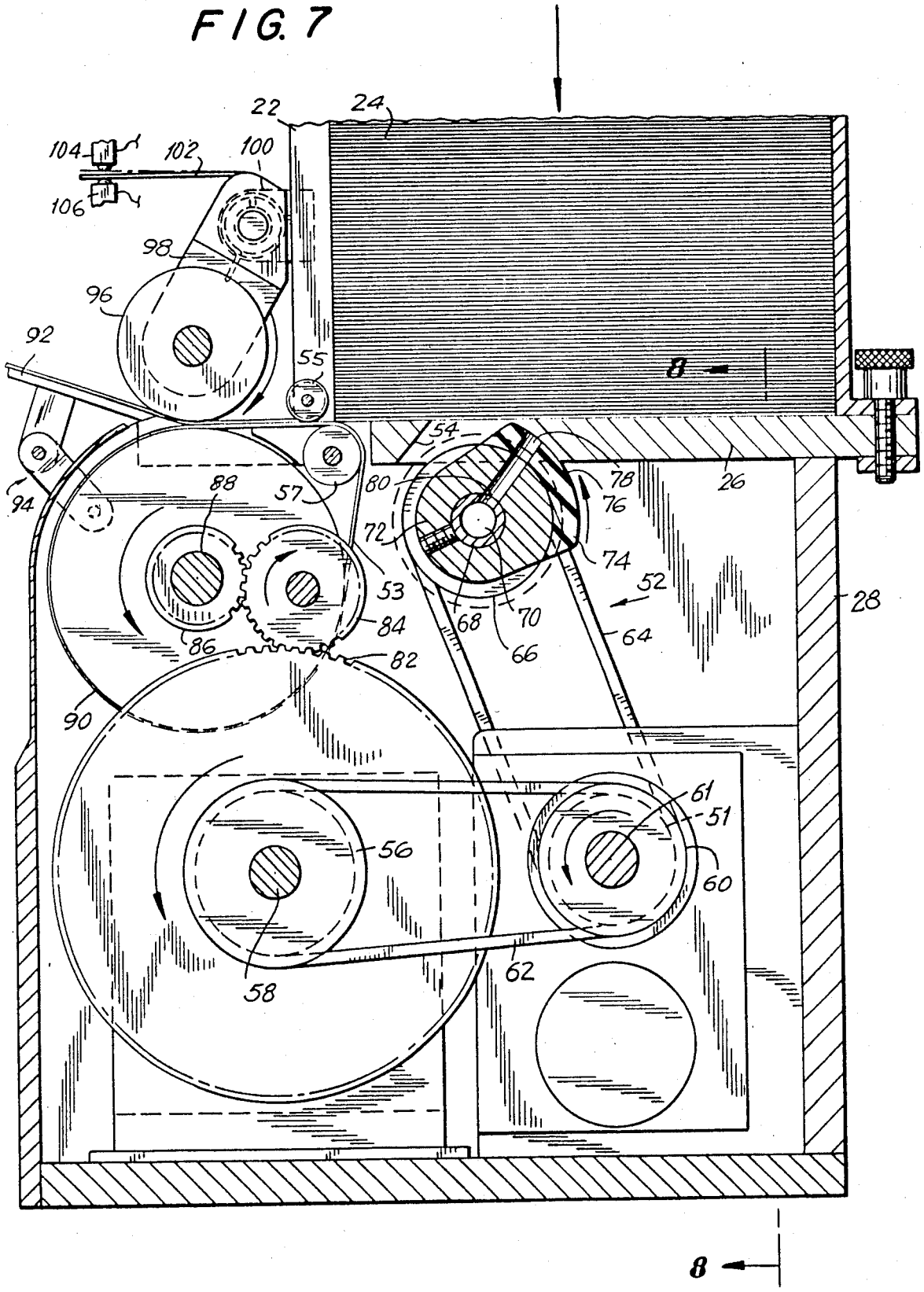
FIG. 7 is a cross-sectional view of an insert hopper and the associated kicker assembly for removing the lowermost insert therefrom, of the mail inserting and collating apparatus of FIG. 2.
Figure 7A:
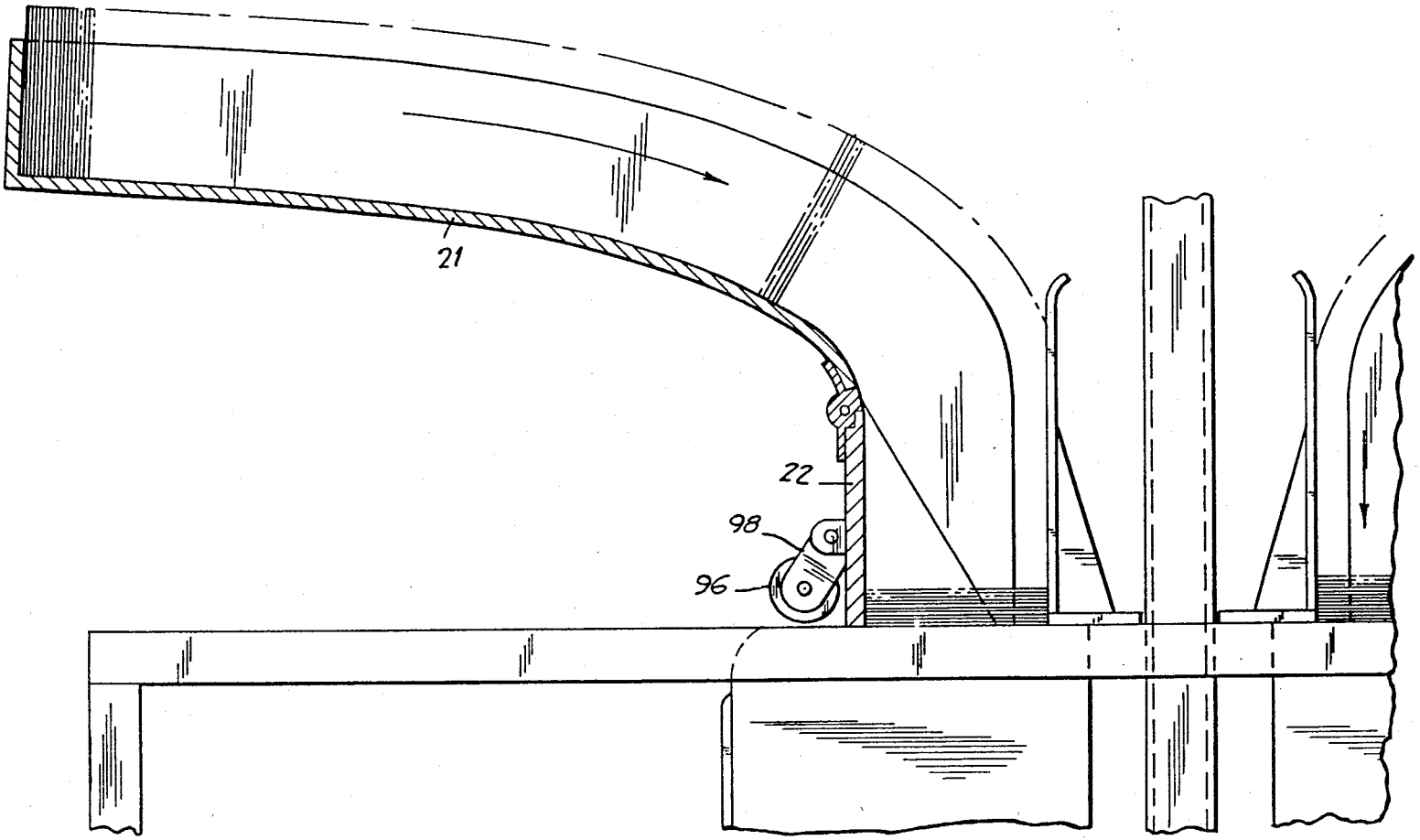
FIG. 7A is a cross-sectional view an insert hopper and the chute for supplying inserts thereto.
Figure 8:
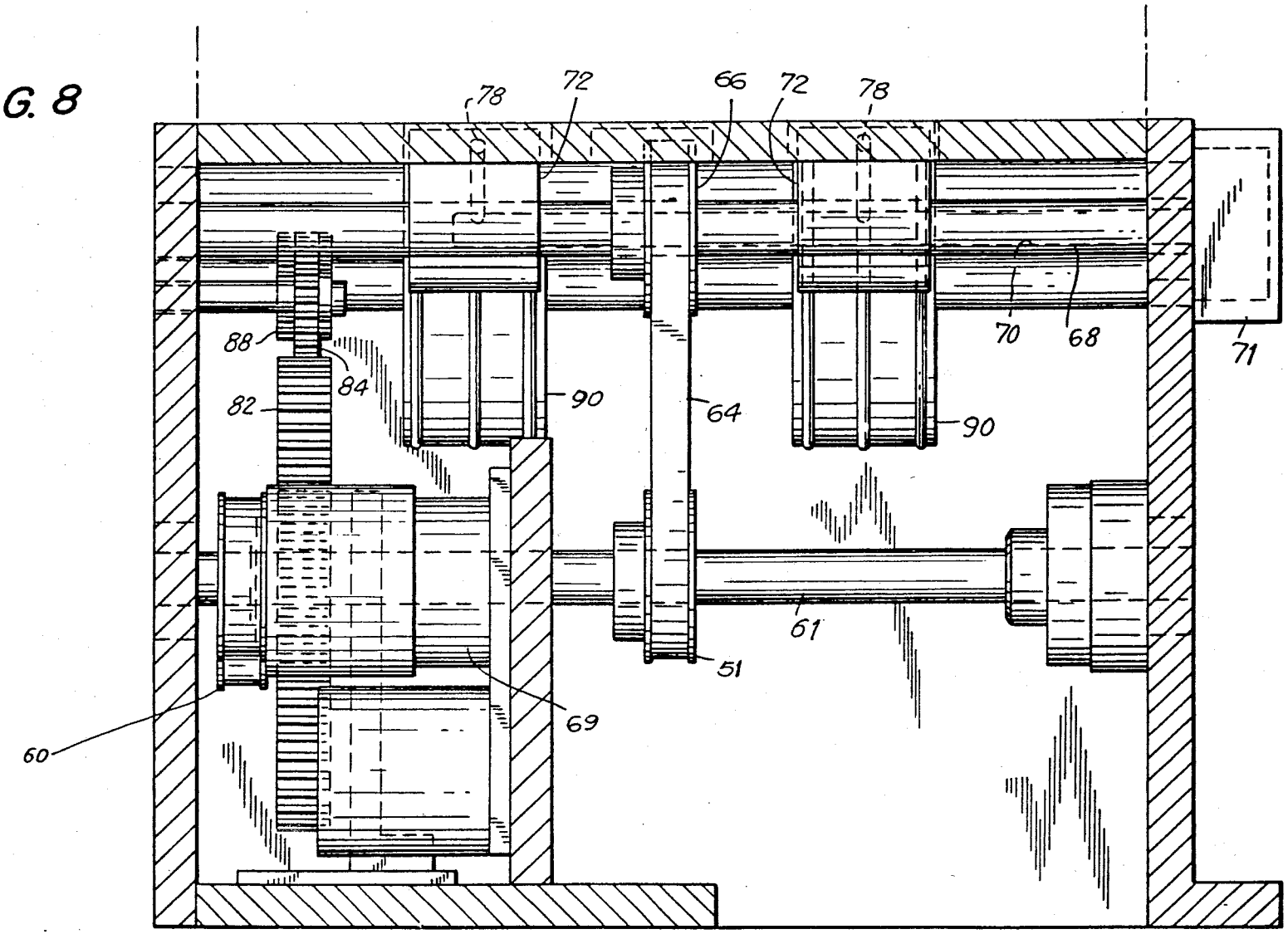
FIG. 8 is a cross-sectional view of the mail inserting and collating apparatus of FIG. 7, taken along line 8—8 thereof.

Referring now to FIG. 7, in order to withdraw the lowermost mailing insert 24 from each insert hopper 22, an insert kicker assembly 52 is provided beneath each insert hopper 22. In this regard, the bottom of each insert hopper is provided with an opening 54. A pulley 56 is secured on motor shaft 58 which continuously rotates. Pulley 56 is connected via belt 62 to pulley 60 which rotates on shaft 61 through a single revolution clutch 69 such that when the clutch is engaged, shaft 61 has a single rotation. Rotatable with shaft 61 is pulley 51 which by means of another belt 64 rotates pulley 66 which is secured on rotatable shaft 68. Shaft 68 is hollow and has a vacuum supplied to the interior 70 thereof from a vacuum connector 71 (FIG. 8), and thereby functions as a vacuum manifold. Vacuum connector 71 is in fluid communication with a vacuum pump (not shown).

In accordance with the present invention, a rubber kicker roller 72 is secured to shaft 68 beneath each insert hopper 22 so as to extend through the respective opening 54 thereof. As shown, each kicker roller 72 has a projecting portion 74 with an arcuate outer surface 76, so that, during rotation of shaft 68, outer surface 76 only engages the lowermost mailing insert 24 through opening 54 during a small arcuate portion of each revolution of kicker roller 72. A vacuum port 78 extends through an aperture 80 in shaft 68, and through kicker roller 72, and projecting portion 74 thereof, to arcuate outer surface 76. Thus, when the rubber arcuate outer surface 76 is rotated into engagement with the lowermost mailing insert 24, a vacuum is also applied thereto through vacuum port 78. When kicker roller 72 is rotated past a certain angular extent, the vacuum is released, and the lowermost mailing insert 24 is kicked or shot out of the insert hopper 22. Thus, the combination of rubber arcuate outer surface 76 with the use of a vacuum, provides a novel positive kicking out of the lowermost mailing insert 24.

As also shown in FIG. 7, a gear 82 is connected on motor drive shaft 58 and rotates therewith. Gear 82 is in meshing engagement with another gear 84 which, in turn, is in meshing engagement with another gear 86 secured on a rotatable shaft 88. Thus, since drive shaft 58 is continuously rotated, shaft 88 is also continuously rotated. A roller 90 is also secured on shaft 88, and has its outer surface positioned to engage and further drive the lowermost mailing insert 24 shot out from the insert hopper 22, onto an adjustable ramp 92. Ramp 92 is secured to framework 28 by a hinged lever arrangement 94, whereby the height and inclination of ramp 92 can be varied.

A freely rotatable roller 55 is positioned in front of hopper 24 and forms a nip with a lower roller 57, the latter being driven through a belt 53 by roller 90. A freely rotatable roller 96 is positioned above roller 90, such that the lowermost mailing insert 24, from the nip of rollers 55 and 57, travels between the nip of rollers 90 and 96. Roller 96 is rotatably secured to a roller support 98 which is pivotally mounted to a bracket 100 secured to the respective insert hopper 22.

A detection lever 102 is also secured to roller support 98 and rotates therewith, the free end of detection lever 102 being positioned between an upper adjustable contact 104 and a lower adjustable contact 106. When no insert 24 is removed from the insert hopper 22, roller support 98 is pivoted in the counter-clockwise direction of FIG. 7 about bracket 100, whereby detection lever 102 contacts lower contact 106. As a result, a signal is sent to appropriate circuitry to indicate that no insert 24 is present. On the other hand, if two or more inserts 24 are kicked out of insert hopper 22, roller support 98 is pivoted in the clockwise direction of FIG. 7 about bracket 100, whereby detection lever 102 contacts upper contact 104. As a result, a signal is sent to appropriate circuitry to indicate that two or more inserts 24 are present. The application of such signals will be made apparent from the discussion which follows.

Figure 6:
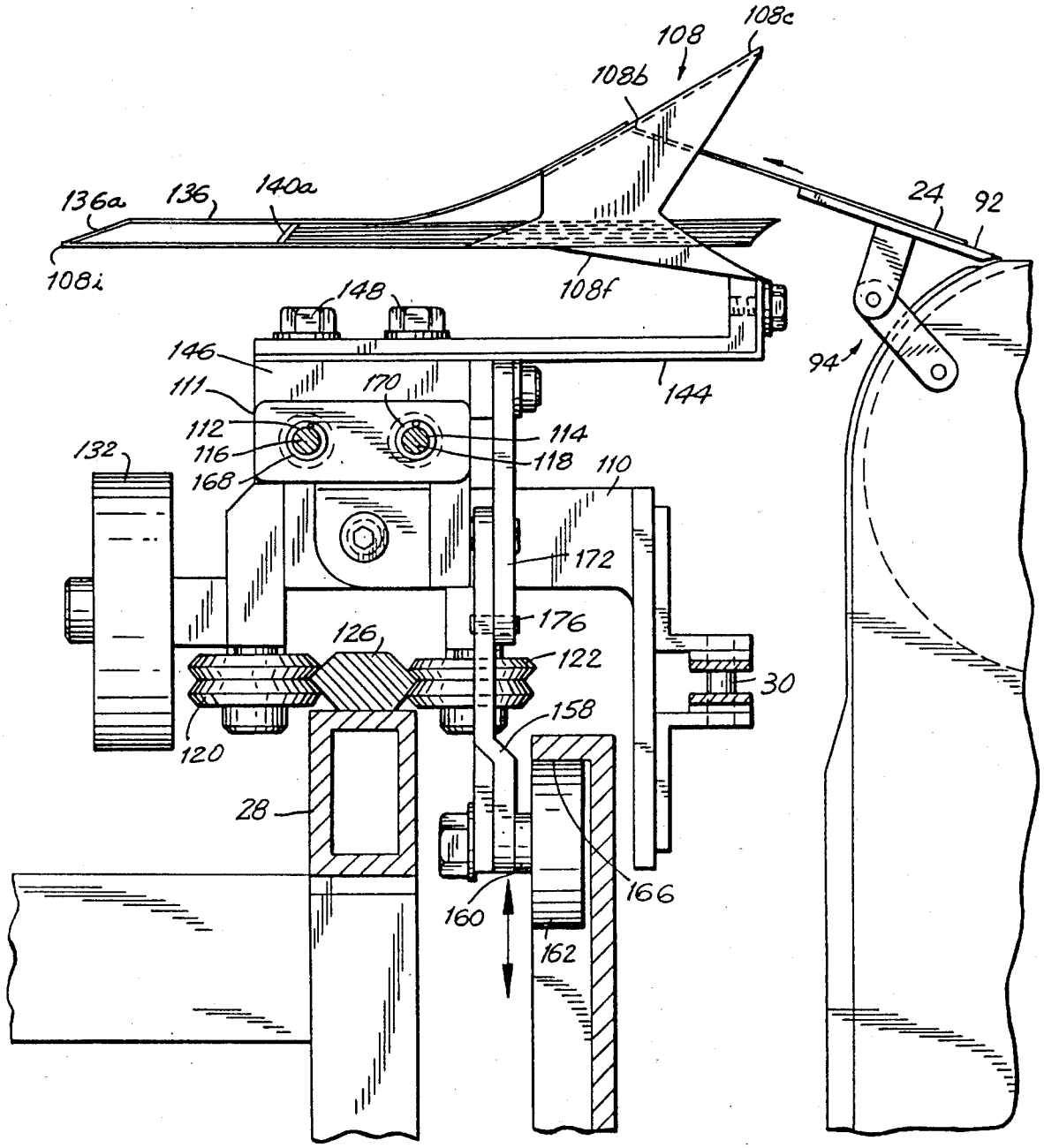
FIG. 6 is cross-sectional view of a pocket and the pocket conveyor of the mail inserting and collating apparatus of FIG. 2.

As discussed above, insert conveyor 30, in the form of a continuous chain, is formed in a horizontal plane in surrounding relation to insert hoppers 22. A plurality of pockets 108, for example, twenty-four pockets 108, are secured to insert conveyor 30 in spaced relation. More particularly, and with reference to only one pocket 108, as shown in FIG. 6, a bracket 110 is secured to insert conveyor 30. Bracket 110 includes a central guide section 111 having spaced apart through bores 112 and 114 through which guide rails 116 and 118 (FIG. 9), respectively, extend. Thus, bracket 110 is guided by guide rails 116 and 118 and pulled thereon by insert conveyor 30 as the latter moves past insert hoppers 22. In order to provide additional support, guide rollers 120, 122 and 124 (FIGS. 6 and 9), which are rotatably secured to a lower portion of bracket 110, ride along an additional guide rail 126 secured to framework 28. As previously discussed, insert conveyor 30 moves along an oblong track. Therefore, as shown in FIG. 2, arcuate guide tracks 128 and 130 are provided at opposite ends of insert conveyor 30, and a tire 132 rotatably secured to an end of bracket 110 rides upon arcuate guide tracks 128 and 130 at the ends of insert conveyor 30. Tires 132 are provided, since it is difficult to travel around the turns with the V-shaped grooves of guide rollers 120, 122 and 124.

Figure 9:
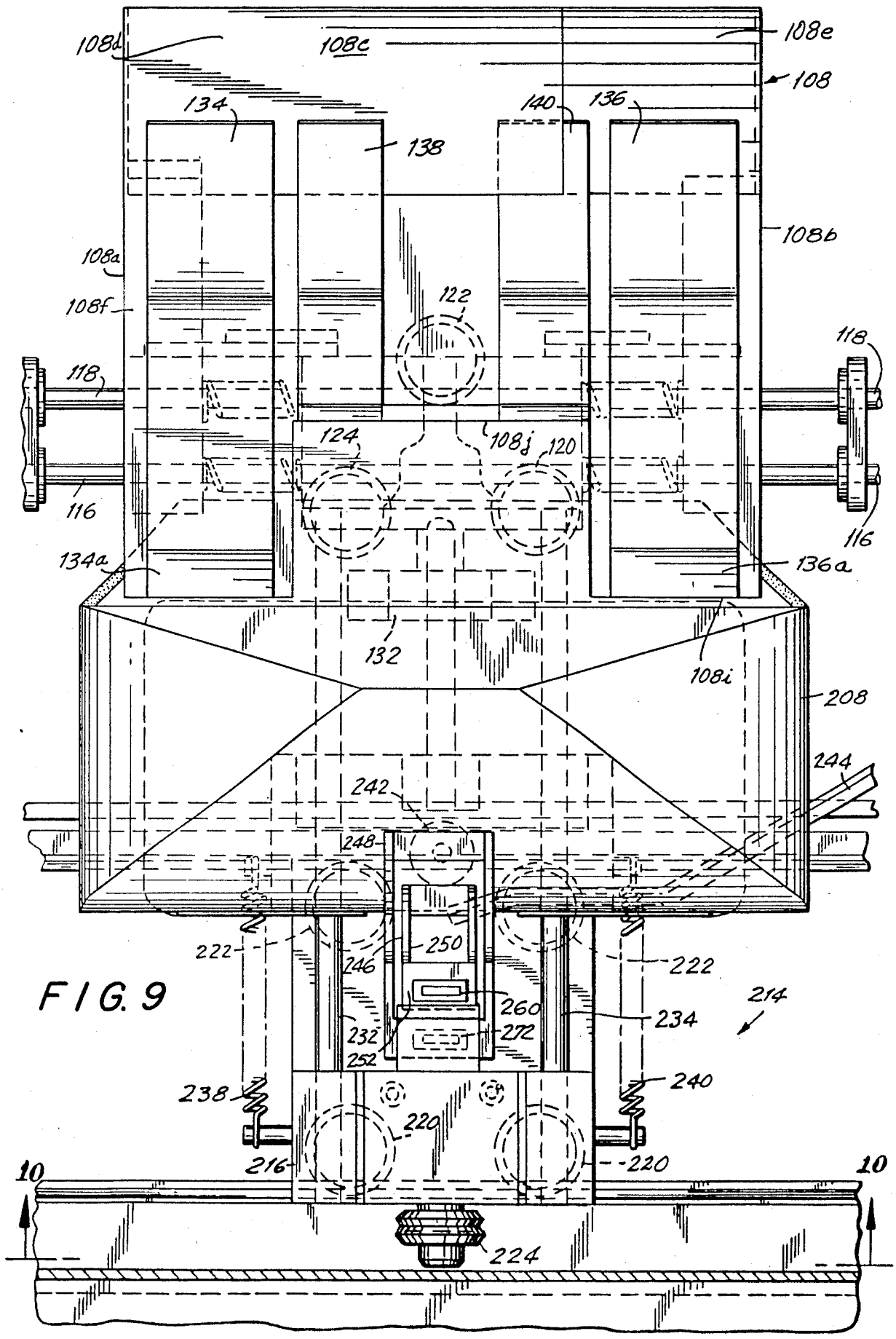
FIG. 9 is a top plan view of the insert and envelope merge station of the mail inserting and collating apparatus of FIG. 2, just prior to the inserts being received in the envelope thereat.
Figure 17:
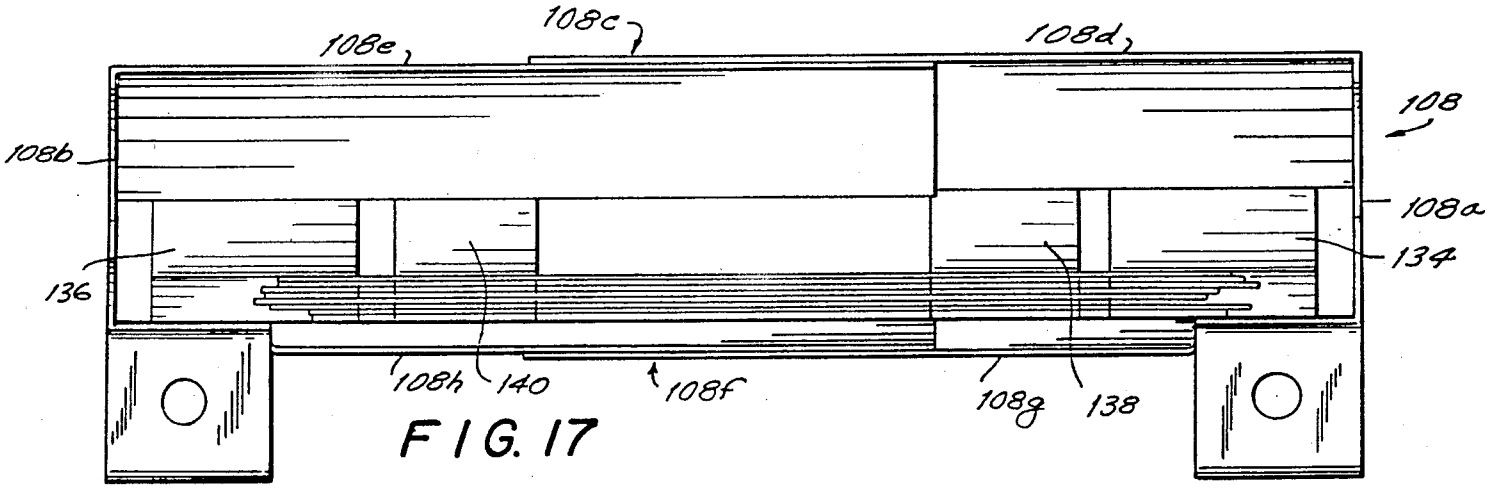
FIG. 17 is a rear plan view of the pocket of FIG. 16, viewed from line 17—17 thereof, illustrating the length of the pocket prior to being moved to the insert and envelope merge station.

Pocket 108 is indirectly secured to the upper end of bracket 110, as will be described in detail hereinafter, and thereby rides along the oblong track of insert conveyor 30, past each insert hopper 22. As shown in FIGS. 6, 9 and 17, each pocket 108 is formed with opposite side walls **108*a* and 108*b* which are movable toward or away from each other, whereby the length of the pockets 108 can be varied to accommodate different size inserts 24, and for aligning the inserts 24 at a later time for insertion into the envelopes. A top wall 108*c* is formed by an upper wall section 108*d* extending from the upper end of side wall 108*a*, and an upper wall section 108*e* extending from the upper end of side wall 108*b* in overlapping and sliding relation to upper wall section 108*d*. Thus, when side walls 108*a* and 108*b* are moved toward or away from each other, upper wall sections 108*d* and 108*e* move similarly with respect to each other. As shown in FIGS. 6 and 9, side walls 108*a* and 108*b*, and upper wall sections 108*d* and 108*e*, extend only a portion of the width of pocket 108, at the rear of pocket 108, and thereby do not extend to the front edge 108*i* of pocket 108**.

Pocket 108 further includes a bottom wall **108*f* formed from a lower wall section 108*g* extending from the lower end of side wall 108*a*, and a lower wall section 108*h* extending from the lower end of side wall 108*b* in overlapping and sliding relation to lower wall section 108*g*. Portions of bottom wall 108*f* adjacent side walls 108*a* and 108*b* extend the entire width of pocket 108, that is, to front edge 108*i* thereof, while a central portion 108j thereof is cut out and thereby does not extend to front edge 108*i*. The rear portion of bottom wall 108*f* is indirectly secured to bracket 110, as shown in FIGS. 6 and 14**.

The rear end of pocket 108 is open to permit the pocket 108 to receive mailing inserts 24, as shown in FIG. 6. In this regard, in order to ensure that mailing inserts 24 are unobstructed in their entry into the respective pocket 108, top wall **108*c* is inclined upwardly to the rear of pocket 108, and bottom wall 108***f* is inclined downwardly to the rear of pocket 108, thereby defining an enlarged open rear section of pocket 108. When the mailing inserts are inserted into pocket 108, ramp 92 is inclined as shown in FIG. 6 so that each insert hits top wall 108*c* at the same position, and then falls onto the stack of inserts already in pocket 108, thereby ensuring proper stacking of the inserts in pocket 108. In addition, when pocket 108 is to receive mailing inserts 24, side walls 108*a* and 108*b* are moved away from each other, as will be explained in greater detail hereinafter.

Each pocket 108 further includes a pair of long leaf spring fingers 134 and 136, and a pair of short leaf spring fingers 138 and 140, all of the leaf spring fingers being secured at one end to top wall 108*c* and having a free end extending toward the front edge 108*i* of pocket 108. Specifically, long leaf spring fingers 134 and 136 are secured to upper wall sections 108*d* and 108*e*, respectively, adjacent side walls 108*a* and 108*b*, with the free ends thereof extending to the front edge 108*i* of pocket 108. Short leaf spring fingers 138 and 140 are secured to upper wall sections 108*d* and 108*e*, respectively, at positions spaced inwardly from long leaf spring fingers 134 and 136, in the lengthwise direction of pocket 108, and the free ends of which terminate short of the front edge 108*i* of pocket 108. As shown in FIG. 6, the free ends 134*a*, 136*a*, 138*a* and 140*a* of each leaf spring finger 134, 136, 138 and 140 are bent downwardly so as to touch and thereby provide a slight force against bottom wall 108*f*. In this regard, when mailing inserts 24 are first received in a pocket 108, they travel in only as far as the free ends 138*a* and 140*a* of short leaf spring fingers 138 and 140, as shown in FIG. 6.

Figure 10:
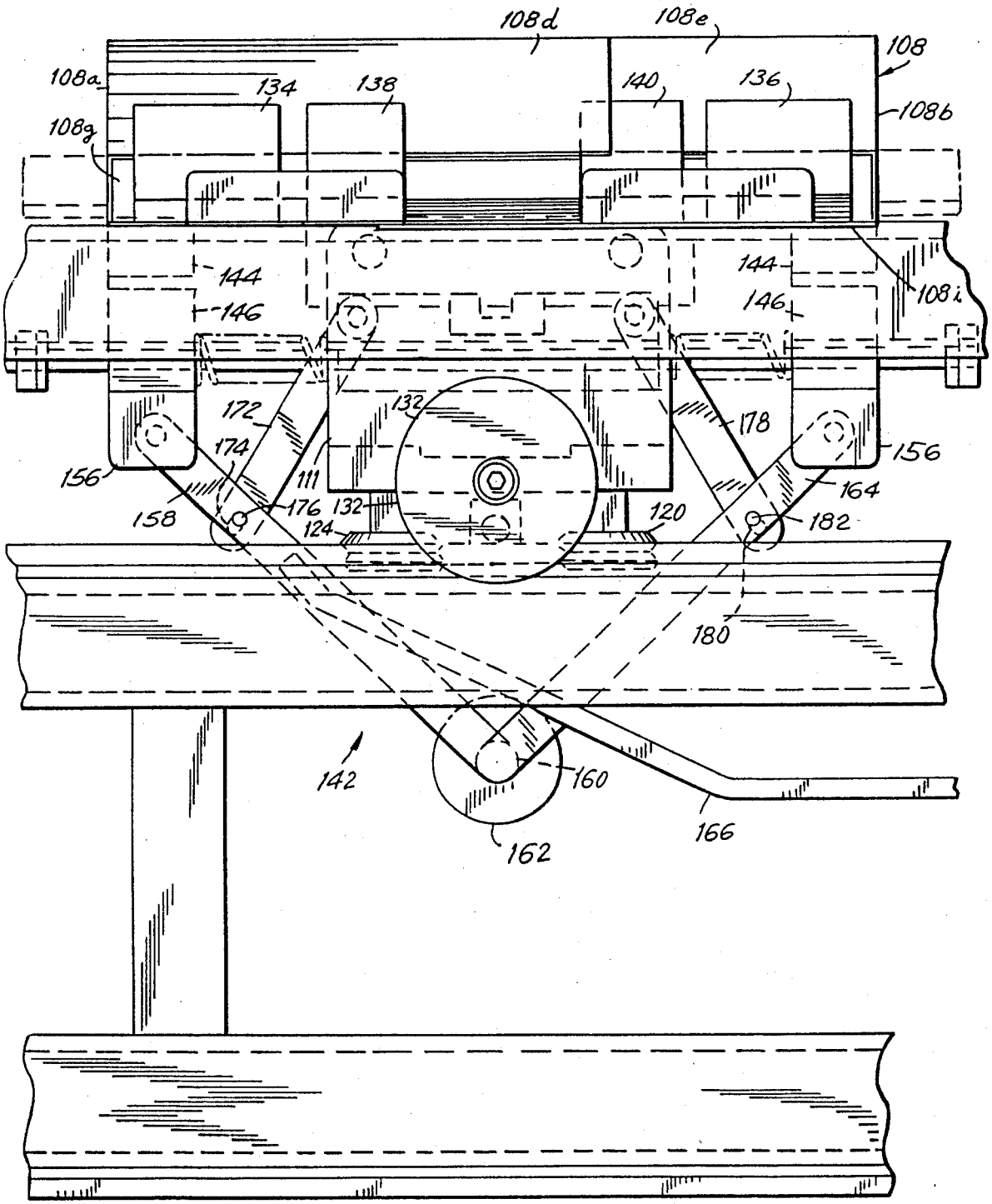
FIG. 10 is a cross-sectional view of the mail inserting and collating apparatus of FIG. 9, taken along line 10—10 thereof.
Figure 14:
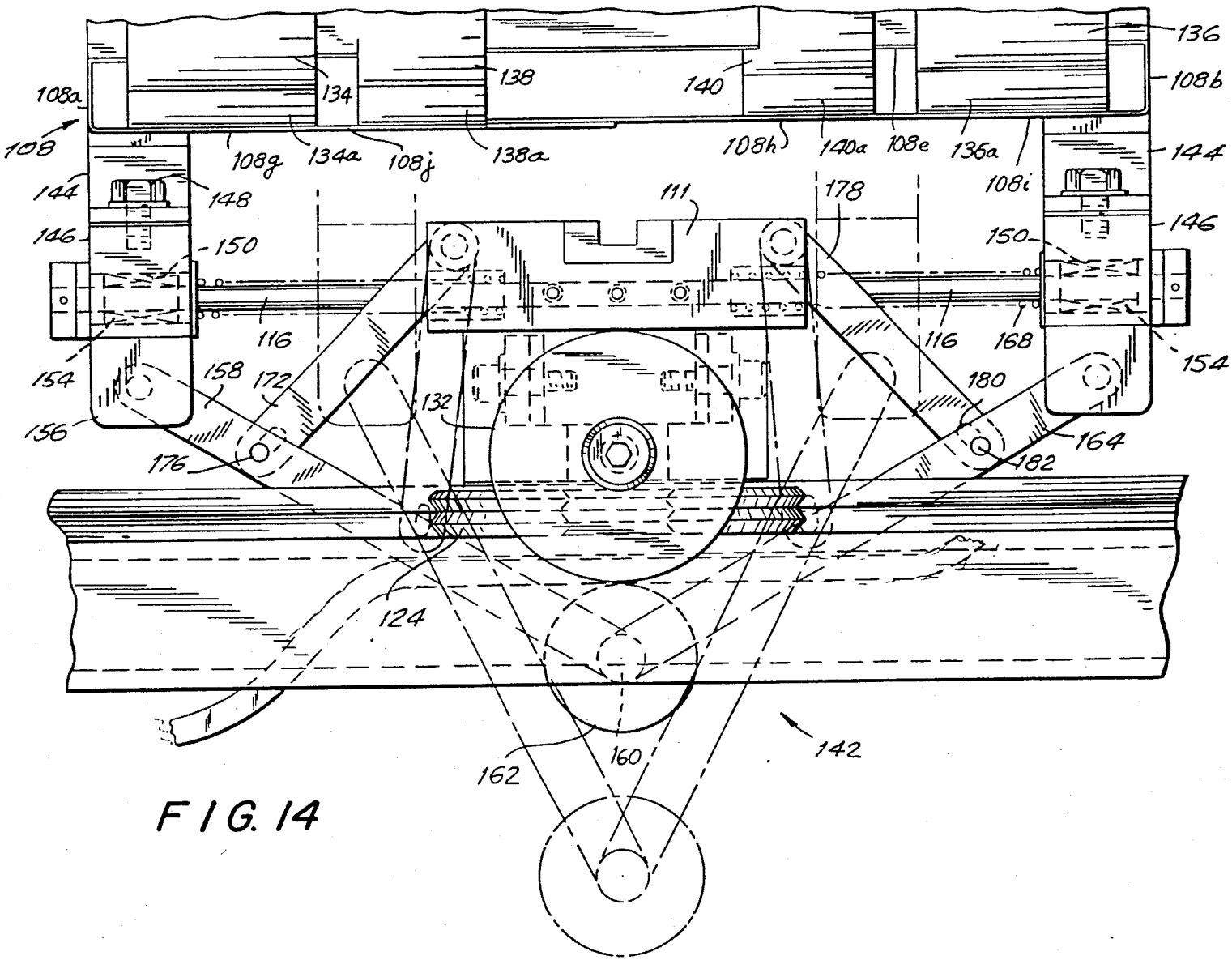
FIG. 14 is a side elevational view of the assembly for changing the length of the pocket at the insert and envelope merge station of the mail inserting and collating apparatus of FIG. 2, viewed along line 14—14 of FIG. 13, after the filled envelope has been withdrawn from the pocket.

Referring now to FIGS. 6, 10 and 14, a pocket adjustment assembly 142 is provided to secure pocket 108 to bracket 110 and to adjust the length of each pocket 108, that is, to move side walls 108*a* and 108*b* either closer to or farther from each other. Specifically, an L-shaped bracket 144 is secured to each lower wall section 108*g* and 108*h*, adjacent side walls 108*a* and 108*b*, respectively. A guide block 146 is secured to the end of each L-shaped bracket 144 by bolts 148, and extends downwardly therefrom as viewed in FIGS. 6, 10 and 14. Each guide block 146 is provided with two through bores 150, and a bearing assembly 154 is positioned in each through bore 150. Thus, guide rails 116 and 118 extend through bores 150, and are slidable therein by means of bearing assemblies 154. In this manner, each pocket 108 is slidably mounted along guide rails 116 and 118.

A pivot support 156 is connected to and extends downwardly from each guide block 146. A first extension arm 158 is pivotally connected at one end thereof to one pivot support 156, and has its opposite end pivotally connected to a shaft 160 which also rotatably carries a cam follower roller 162 thereon. In like manner, a second extension arm 164 is pivotally connected at one end thereof to the other pivot support 156, and has its opposite end pivotally connected to shaft 160. Cam follower roller 162 rides along the underside of a cam track 166. In this regard, first coil springs 168 are positioned about guide rail 116 on opposite sides of central guide section 111, between central guide section 111 and each guide block 146, and second coil springs 170 are positioned about guide rail 118 on opposite sides of central guide section 111, between central guide section 111 and each guide block 146. Coil springs 168 and 170 thereby normally bias guide sections 146 away from central guide section 111, whereby side walls 108*a* and 108*b* of each pocket 108 are normally biased away from each other to open pocket 108 to its greatest lengthwise dimension. At the same time, through extension arms 158 and 164, cam follower roller 162 is pulled upwardly so as to engage and ride along cam track 166.

A first lever arm 172 is pivotally connected at one end thereof to central guide section 111 and at the opposite end to first extension arm 158 at a position approximately one-third of the way from guide block 146 to shaft 160. As shown, a slot 174 is formed at the latter end of first lever arm 172 through which a pivot pin 176 rides for pivotally connecting first lever arm 172 to first extension arm 158. In like manner, a second lever arm 178 is pivotally connected at one end thereof to central guide section 111 and at the opposite end to second extension arm 164 at a position approximately one-third of the way from guide block 146 to shaft 160. As shown, a slot 180 is formed at the latter end of second lever arm 178 through which a pivot pin 182 rides for pivotally connecting second lever arm 178 to second extension arm 164. Thus, during movement of cam follower roller 162 along cam track 166, so as to cause enlargement or reduction of pocket 108, lever arms 172 and 178 stabilize, center and aid in the movement of guide blocks 146 along guide rails 116 and 118.

With the arrangement thus far described, each pocket 108 receives a mailing insert 24 from selected insert hoppers 22 as it rides along insert conveyor 30, starting with the #1 insert hopper 22 and ending with the #12 insert hopper 22. Each mailing insert 24 is kicked or shot out into the respective pockets 108, on top of the previous mailing insert 24 received therein. All of the mailing inserts 24 are therefore received in each pocket 108, and extend forwardly to the free ends 138*a* and 140*a* of short leaf spring fingers 138 and 140, as shown in FIG. 6.

Figure 16:
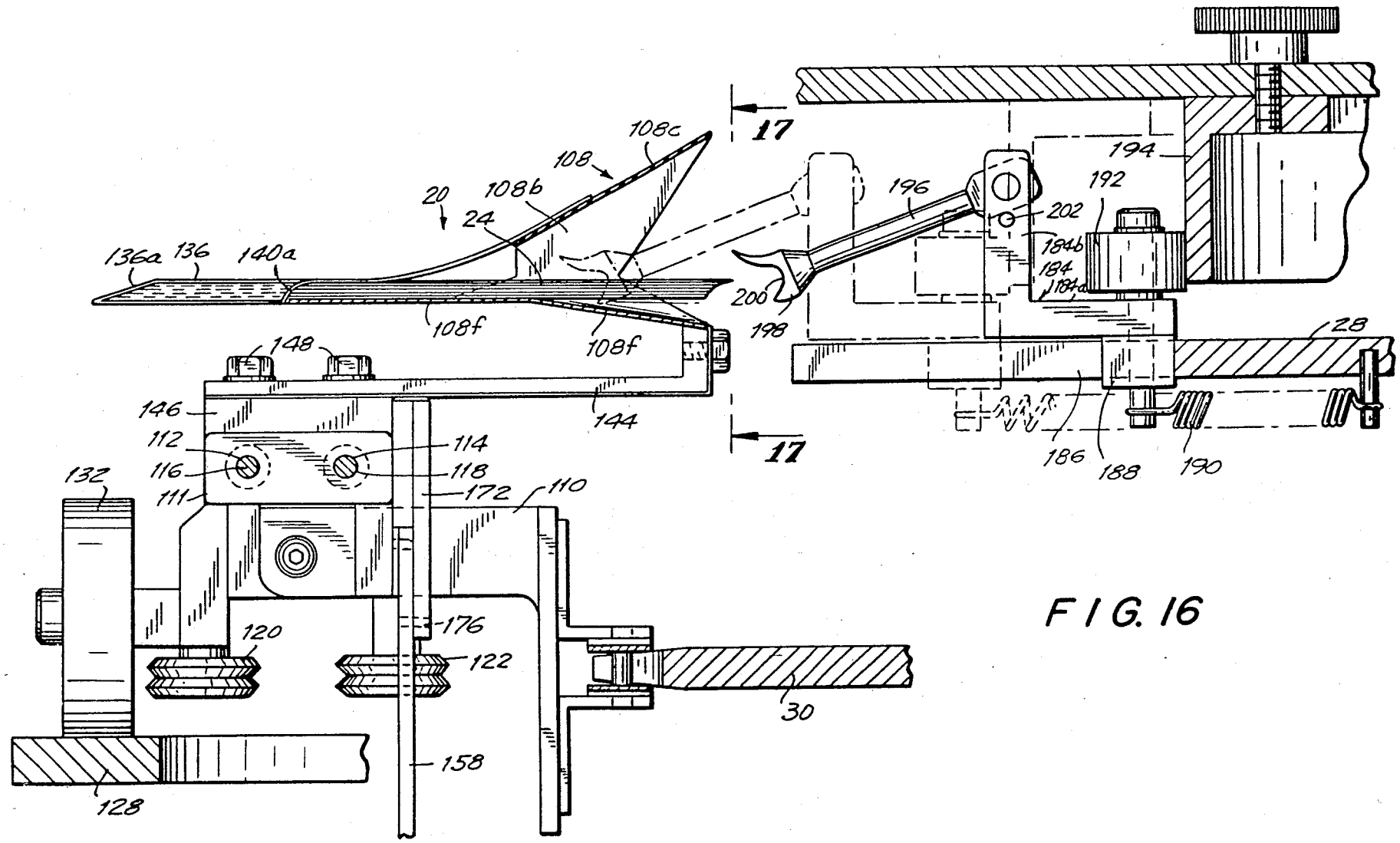
FIG. 16 is side elevational view of a pusher assembly of the mail inserting and collating apparatus of FIG. 2 that pushes the inserts toward the front of the respective pocket prior to the pocket being moved to the insert and envelope merge station.

Thereupon, each pocket 108 travels from #12 insert hopper 22 around sprocket 32 and arcuate guide track 128. During such latter travel, the inserts 24 in pocket 108 are biased forwardly past the free ends 138*a* and 140*a* of short leaf spring fingers 138 and 140 to the free ends 134*a* and 136*a* of long leaf spring fingers 134 and 136, as shown in FIG. 16. As shown in FIGS. 2 and 16, an L-shaped bracket 184 is secured to framework 28. Specifically, L-shaped bracket 184 includes a horizontal leg 184*a* mounted within a slot 186 in framework 28 by means of a guide 188, and is adapted to move in the radial direction of sprocket 32. A coil spring 190 is connected between a lower part of guide 188, and framework 28, for normally biasing L-shaped bracket 184 to the right in FIG. 16. A cam follower roller 192 is rotatably mounted on horizontal leg 184*a*, and rides along an oblong, stationary, adjustable cam track 194, that extends about insert conveyor 28. Cam track 194 has a plurality of radially raised sections which bias cam follower roller 192, and thereby L-shaped bracket 184, to the left of FIG. 16 against the force of coil spring 190, as shown in dashed lines in FIG. 16. Specifically, L-shaped bracket 184 is biased to the left of FIG. 16 in timed relation to the passing of a pocket 108.

Figure 18:
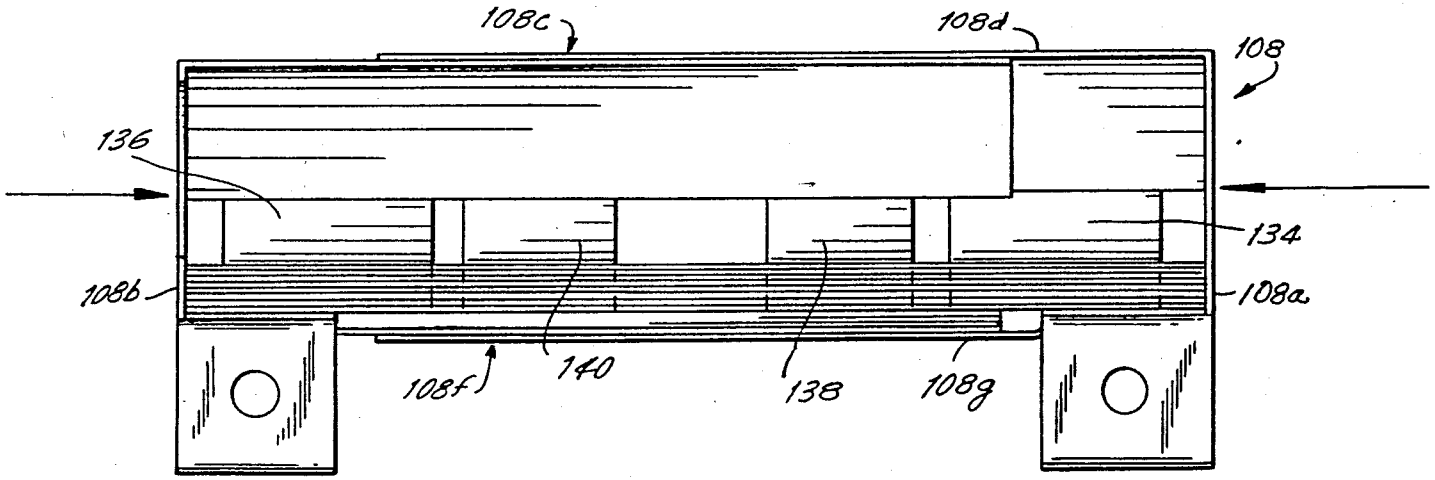
FIG. 18 is a rear plan view of the pocket of FIG. 17, after its length has been reduced at the insert and envelope merge station.

L-shaped bracket 184 includes a vertical leg 184*b* at the radially outward end of horizontal leg 184*a*. Three pushers 196 are pivotally secured in a floating manner at the upper end of vertical leg 184*b* in spaced relation. Each pusher 196 is formed at the free end thereof with nylon pusher head 198 having a substantially V-shaped groove 200 which is vertically oriented. A stop pin 202 is also formed on vertical leg 184b at a position immediately below pushers 196 for limiting the counter-clockwise rotation thereof to the position shown in solid lines in FIG. 16. Thus, as each pocket 108 is rotated about sprocket 32, L-shaped bracket 184 is moved to the left of FIG. 16 in timed relation therewith. During such movement, the inserts 24 in pocket 108 are engaged in V-shaped grooves 200, such that pusher heads 198 move inserts 24 toward the forward end of pocket 108, past the free ends 138a and 140a of short leaf spring fingers 138 and 140, up to the free ends 134a and 136a of long leaf spring fingers 134 and 136. During continued movement of pocket 108 along insert conveyor 30, L-shaped bracket 184 and pushers 196 are moved to the right of FIG. 16 by coil spring 190. During this time, side walls 108a and 108b have the configuration shown in FIG. 18. Thereafter, pocket 108 is moved to the insert and envelope merge station 204, which will be described in greater detail hereinafter.

Figure 3:
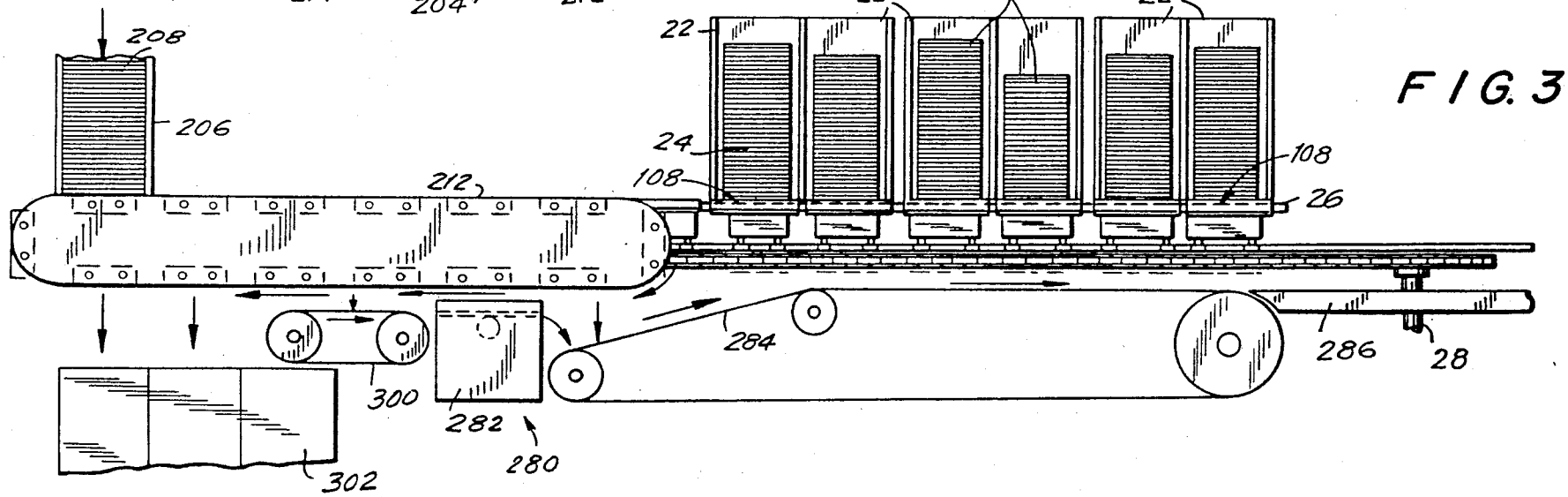
FIG. 3 is a side elevational view of the mail inserting and collating apparatus of FIG. 2.

Referring back to FIGS. 1–3, an envelope hopper 206 is provided and contains a stack of envelopes 208 having open flaps 210. As with insert hoppers 22, the lowermost envelope 208 is kicked out from envelope hopper 206 by a kicker roller (not shown) which is similar to kicker rollers 72, and is carried by an envelope conveyor 212 in the form of a conveyor chain having an oblong configuration and oriented in a vertical plane. In this regard, it is noted that this embodiment is an off-line arrangement in which the direction of feed of the envelopes 208 is perpendicular to the direction of movement of the envelope conveyor 212.

Figure 11:
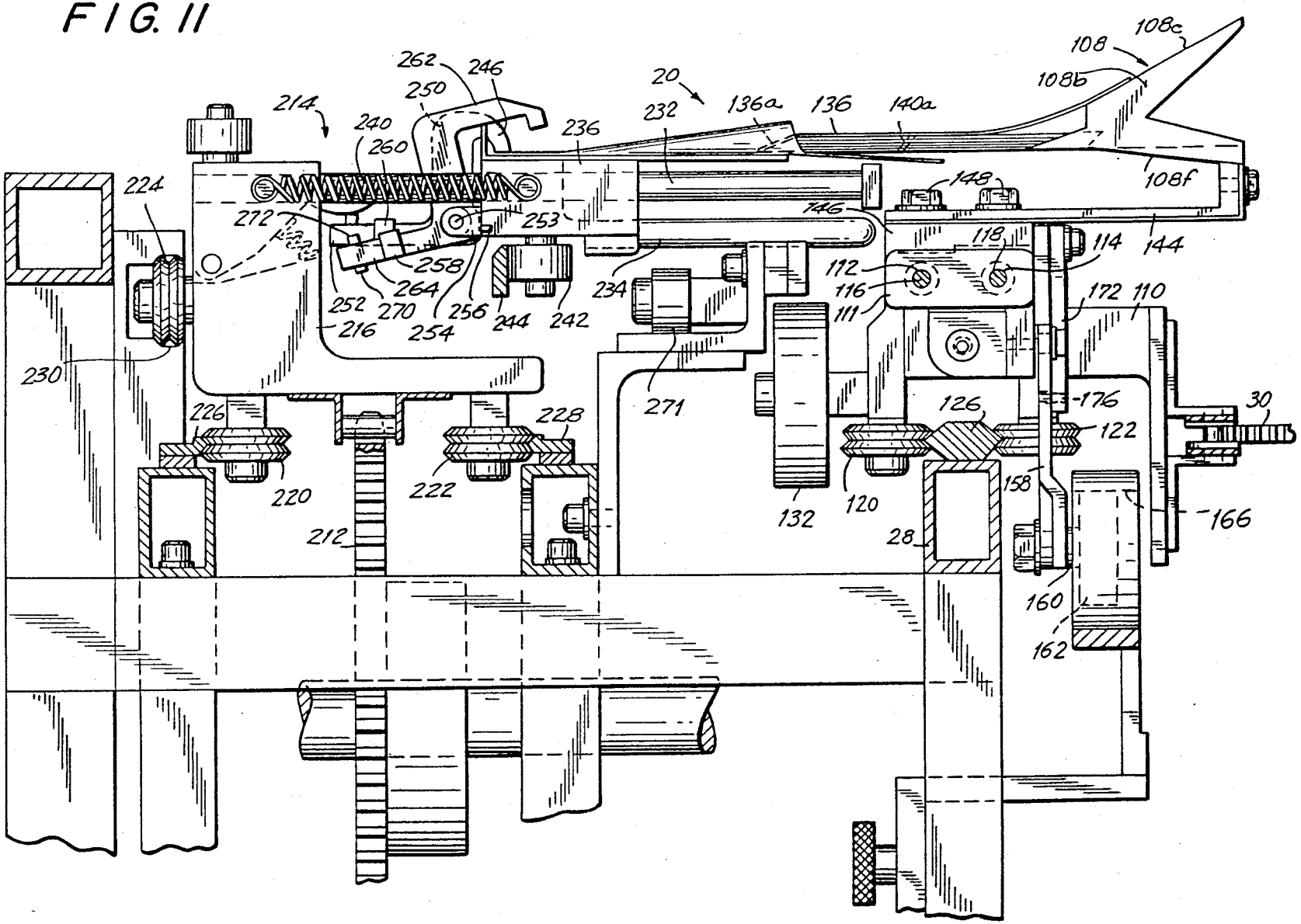
FIG. 11 is a side elevational view of the insert and envelope merge station of the mail inserting and collating apparatus of FIG. 2, just prior to the inserts being received in the envelope thereat.
Figure 15:
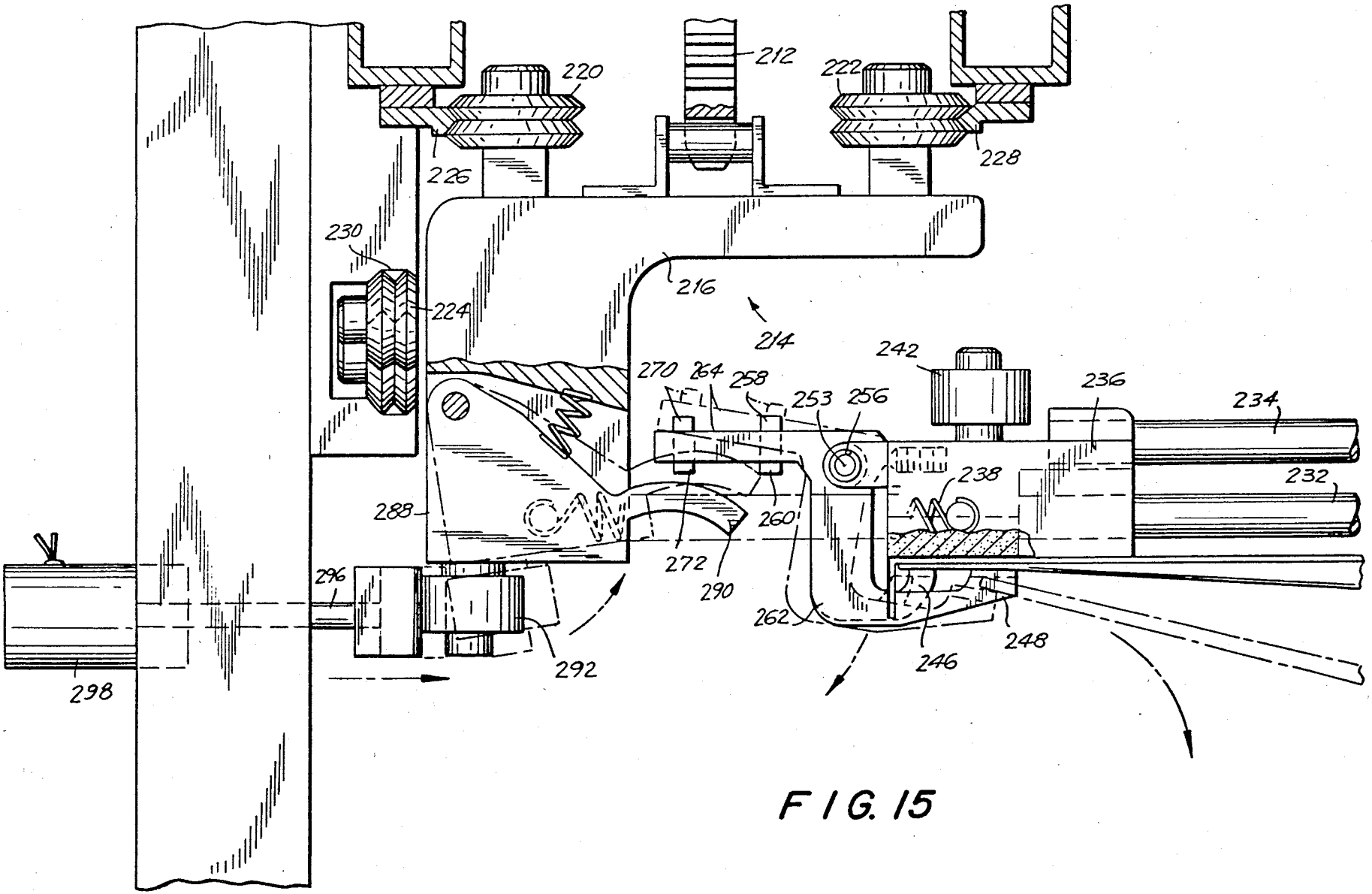
FIG. 15 is a cross-sectional view of the two finger assembly of the mail inserting and collating apparatus of FIG. 2, used for grasping the envelopes.

More particularly, a plurality of, for example, twelve, envelope carriers 214 are mounted with envelope conveyor 212 for movement therewith, each envelope carrier 214 adapted to carry one envelope 208. Hereinafter, only one envelope carrier 214 will be described. As shown in FIGS. 9, 11 and 15, envelope carrier 214 includes an L-shaped guide block 216, and oblong conveyor 212 is secured to L-shaped guide block 216 for pulling the same therewith. Guide block 216 is guided by guide rollers 220 rotatably secured to the underside of guide block 216, guide rollers 222 also rotatably secured to the underside of guide block 216, and a guide roller 224 rotatably secured to a side of guide block 216. Guide rollers 220 ride along the inside of a guide track 226, guide rollers 222 ride along the inside of a guide track 228 and guide roller 224 rides in a guide track 230 at portions of its travel when the two turns are made.

Two spaced and parallel guide rails 232 and 234 extend from guide block 216 toward insert conveyor 30, and an envelope support 236 is slidably received on guide rails 232 and 234. The reasons for which will become apparent from the description which follows, envelope support 236 is made of a magnetic material, or at least has portions thereof made of a magnetic material. Coil springs 238 and 240 are connected between the sides of guide block 216 and envelope support 236, and normally bias envelope support 236 to the left of FIG. 11 toward guide block 216. In addition, a cam follower roller 242 is rotatably secured to the underside of envelope support 236, and is biased against a cam track 244 by coil springs 238 and 240, whereby the leftward travel of envelope support in FIG. 11 is limited by cam track 244.

In accordance with an important aspect of the present invention, an envelope finger 246 and an insert finger 248 are provided, the former for grasping the envelope 208 at a position near the longitudinal edge opposite flap 210 thereof, and the latter for grasping the envelope 208 and inserts 24 therein at a position spaced inwardly from envelope finger 246.

More particularly, and with reference to FIGS. 9, 11 and 15, envelope finger 246 is formed with an L-shaped grasping section 250 and an actuating section 252. Envelope finger 246 is pivotally secured by a pivot pin 253 to a bracket 254 at the rear end of envelope support 236, such that grasping section 250 extends over the envelope receiving surface of envelope support 236. Thus, when envelope finger 246 is biased in the clockwise direction of FIG. 11, grasping section 250 thereof clamps down, and thereby grasps, the envelope 208 on envelope support 236. The free end of grasping section 250 is made of a magnetic metal material so that, during such clamping action, the free end of grasping section 250 is held by the magnetic material of envelope support 236. Normally, however, envelope finger 246 is biased in the counterclockwise direction by a conventional ball plunger 256 about pivot pin 253.

In this regard, actuating section 252 is formed with release bearings 258 and 260 extending from opposite sides of actuating section 252. Initially, when envelope carrier 215 is moved in front of envelope hopper 206, torsion spring 256 maintains grasping section 250 away from envelope support 236. When an envelope 208 is kicked out of envelope hopper 206, it is moved to a position such that the longitudinal edge thereof opposite flap 210, is between grasping section 250 and envelope support 236. Thereupon, a cam (not shown) hits release tab 258, and pivots envelope finger 246 about pivot pin 253 against the force of torsion spring 256. As a result of the magnetic attraction between the free end of grasping section 250 and envelope support 236, envelope finger 246 is maintained in this pivoted position, and clamps the longitudinal edge of envelope 208 which is opposite flap 210, and carried the same along envelope conveyor 212, until such time that envelope finger 246 is biased counter-clockwise as viewed in FIG. 11, as will be described later.

In like manner, insert finger 248 is formed with an L-shaped grasping section 262 and an actuating section 264. Insert finger 248 is pivotally secured by pivot pin 253 to bracket 254 at the rear end of envelope support 236, such that grasping section 262 extends over the envelope receiving surface of envelope support 236 in surrounding relation to the grasping section 250 of envelope finger 246, as shown in FIG. 9. It will be appreciated from the discussion which follows that the free end of grasping section 262 of insert finger 248 extends inwardly toward flap 210 to a greater extent than the free end of grasping section 250 of envelope finger 246. Thus, when insert finger 248 is biased in the clockwise direction of FIG. 11, grasping section 262 thereof clamps down, and thereby grasps, the envelope 208 on envelope support 236, along with the inserts 24 therein. The free end of grasping section 262 is also preferably made of a metal so that, during such clamping action, the free end of grasping section 262 is held by the magnetic material of envelope support 236. Normally, however, insert finger 248 is biased in the counter-clockwise direction by another ball plunger about pivot pin 253.

Actuating section 264 is likewise formed with release bearings 270 and 272 extending from opposite sides of actuating section 264. Initially, when an envelope carrier 214 is moved in front of envelope hopper 206, the ball plunger (not shown) controlling insert finger 248 maintains grasping section 262 away from envelope support 236. This is so even when an envelope 208 is kicked out of envelope hopper 206, and is moved to a position such that the longitudinal edge thereof opposite flap 210, is between grasping section 262 and envelope support 236. Accordingly, envelope 208 is only carried by envelope finger 246 at this time.

After envelope 208 has been clamped by envelope finger 246, it is moved along envelope conveyor 212 to a flap opening station 274 which is conventional and is not described herein. Thereupon, air jets 276 (FIG. 1) positioned opposite the opened flap 210 direct a jet of air into envelope 208 to open the same, that is, to prepare envelope 208 to receive mailing inserts 24. Because of the construction of envelope 208, it will remain open during placing of the envelope over the inserts.

Figure 12:
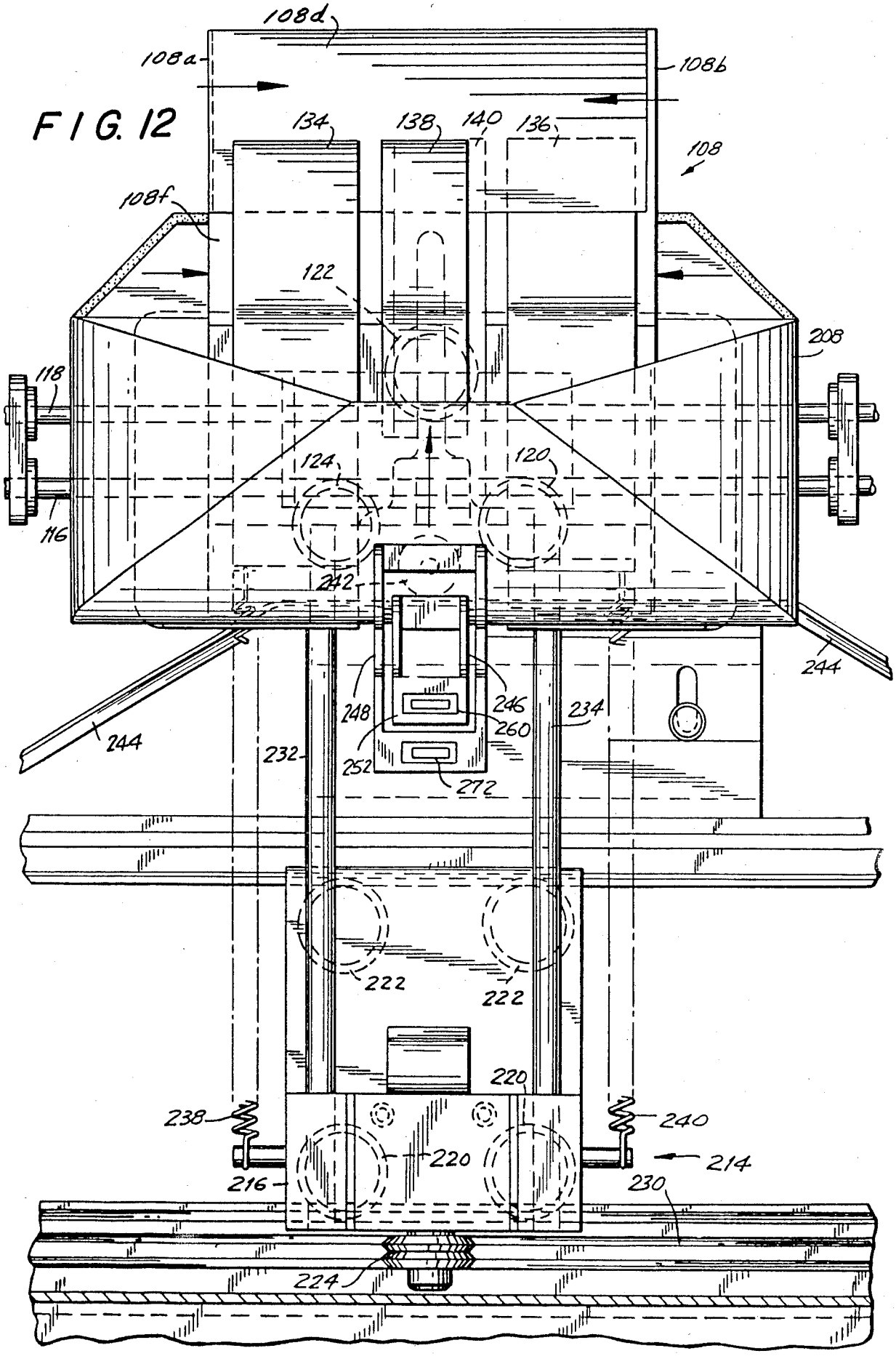
FIG. 12 is a top plan view of the insert and envelope merge station of the mail inserting and collating apparatus of FIG. 2, with the envelope thereat moved toward the pocket to receive the inserts therein.

Just subsequent to the last insert station, cam track 166 bends as shown in FIG. 10. As a result, cam follower roller 162 moves in the downward direction of FIG. 10, causing side walls 108*a* and 108*b* of pocket 108 to move toward each other. The reason for this is twofold. First, it is necessary for the length of pocket 108 to be reduced to a dimension that will fit within envelope 208, as shown in FIGS. 9 and 12. Secondly, such movement of side walls 108*a* and 108*b* pushes mailing inserts 24 together to align the same for insertion into envelope 208.

Figure 13:
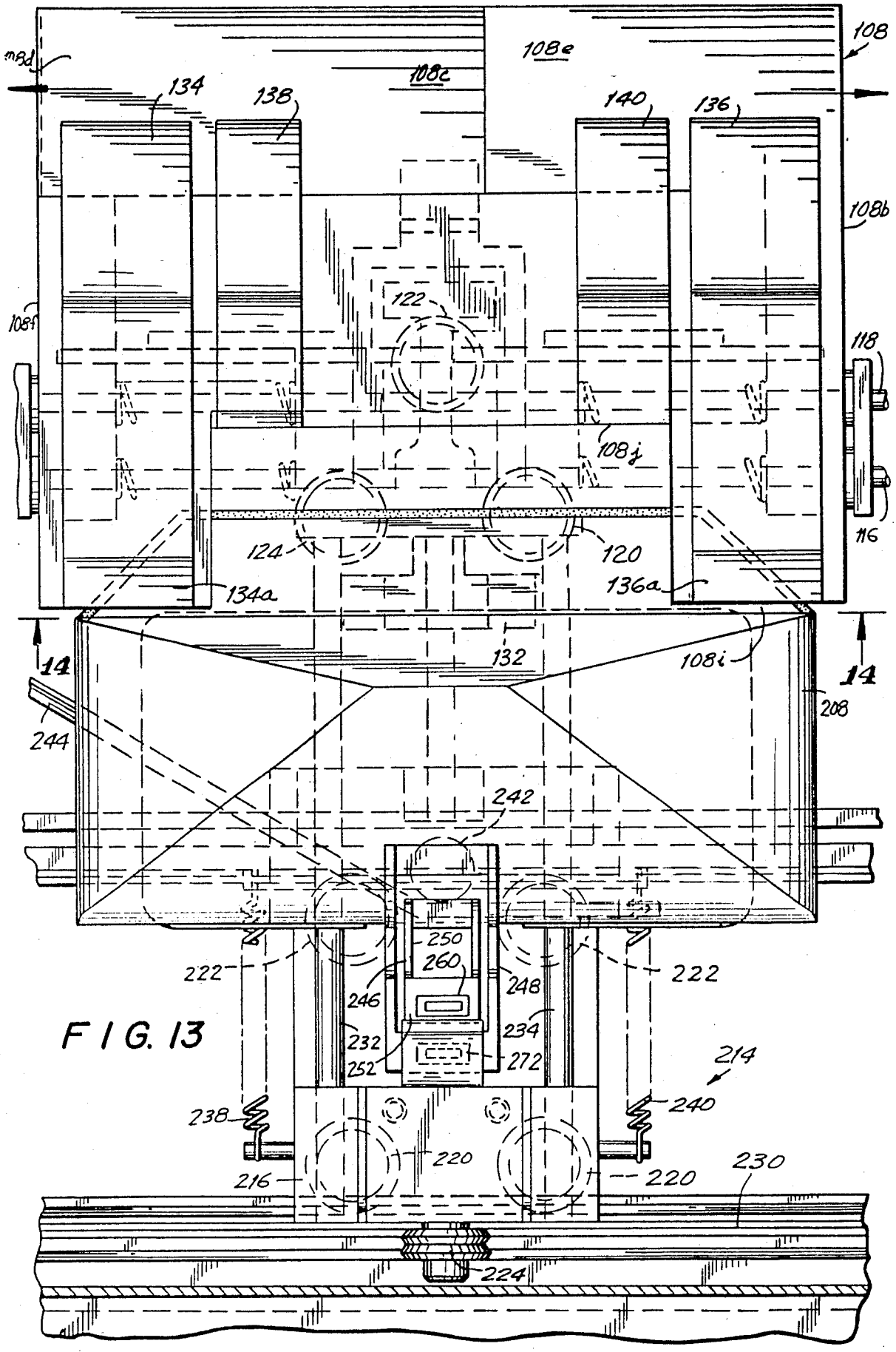
FIG. 13 is a top plan view of the insert and envelope merge station of the mail inserting and collating apparatus of FIG. 2, with the filled envelope withdrawn from the pocket.

As envelope 208 approaches insert and envelope merge station 204, cam track 244 bends toward pocket 108, as shown in FIGS. 9 and 12. Accordingly, cam follower roller 242 follows such bend in cam track 244, causing envelope support 236 to also move toward pocket 108, along guide rails 232 and 234 against the force of coil springs 238 and 240. Thus, pocket 108 is inserted into the open envelope at insert and envelope merge station 204, as shown in FIG. 12. Thereupon, a cam follower bearing 271 (FIG. 11) hits release tab 270 to bias insert finger 248 clockwise in FIG. 11, to clamp down on envelope 208 and mailing inserts 24 therein. During subsequent travel of insert conveyor 30 and envelope conveyor 212, as shown in FIG. 13, cam track 244 bends in the opposite direction away from pocket 108. Accordingly, cam follower roller 242 is caused to ride therealong by reason of the force applied by coil springs 238 and 240. Since envelope 208 moves away from pocket 108, and since insert finger 248 clamps both envelope 208 and mailing inserts 24 therein, the mailing inserts 24 are pulled from pocket 108, and remain within envelope 208. In addition, once pocket 108 is removed from envelope 208, cam track 166 bends again, as shown in FIG. 14, to force cam follower roller 162 to move side walls 108*a* and 108*b* away from each other. Thereafter, the empty pocket 108 is moved by insert conveyor 30 in front of #1 insert hopper 22 to repeat the process. it will be appreciated that synchronization of pockets 108 and envelopes 208 is important when the inserts are inserted into each envelope.

Thus, in accordance with the present invention, the speed of envelope conveyor 212 can be varied as a function of the insert conveyor speed between insert station, such that the envelope speed is a slave to the insert speed, to assure proper synchronism. Specifically, the envelopes and pockets may be caused to move at different, albeit, synchronous, speeds during their travel, with movement of the envelopes being slave to movement of the insert pockets.

As the filled envelope 208 passes insert and envelope merge station 204, the flap 210 thereof is moistened, closed and thereby glued down by a flap closer 278 (FIG. 1), as is conventional. Alternatively, flap closer 278 need not moisten and seal envelope 208, since this can be performed at the subsequent postage station 280 (FIG. 1).

Prior to reaching postage station 280, it is determined by suitable circuitry whether envelope 208 is to pass to the postage meter 282 at postage station 280. If no postage is to be applied, and if all of mailing inserts 24 are received within envelope 208, the latter envelope 208 can merely be dropped on an output conveyor assembly 284 and transported to a table 286 or the like.

In this regard, and referring to FIG. 15, a release lever 288 is pivotally mounted to guide block 216, and has a curved kicker section 290 at one end thereof, which is positioned below release bearings 260 and 272. The opposite free end of release lever 288 has a roller 292 mounted thereto. Normally, release lever 288 is biased in the clockwise direction of FIG. 15 by a spring 294. When envelope 208 is carried to a position before postage station 280, that is, immediately above output conveyor assembly 284, if no postage is to be applied, a plunger 296 of a solenoid 298 pushes against roller 292 to bias release lever 288 in the counter-clockwise direction of FIG. 15 against the force of spring 294. As a result, kicker section 290 thereof hits release bearings 260 and 272 to bias envelope finger 246 and insert finger 248 in the clockwise direction of FIG. 15. Thus, the magnet material of envelope support 236 no longer holds envelope finger 246 and insert finger 248, but rather, the respective torsion springs maintain fingers 246 and 248 away from envelope support 236. Accordingly, envelope 208 is no longer held and drops onto output conveyor assembly 284, and envelope carrier 214 travels around envelope conveyor 212 to receive another envelope 208 from envelope hopper 206.

If postage is to be applied, solenoid 298 is rendered inoperative. Accordingly, envelope 208 is carried to postage station 280, where it is then dropped on a conveyor 300 which carries the envelope 208 into postage meter 282 which applies postage thereto and which then shoots the envelope 208 out to output conveyor assembly 284. It will be appreciated that because of the orientation of envelope conveyor 212 in a vertical plane, each envelope 208 is turned upside down to prepare it for postage meter 282.

If there has been a misfeed of an insert or inserts 24 from insert hoppers 22, as detected, for example, by detection lever 102 and upper contact 104 or lower contact 106, the envelope 208 is dropped into one of a plurality of bins 302, depending on which inserts were misfed.

Figure 19:
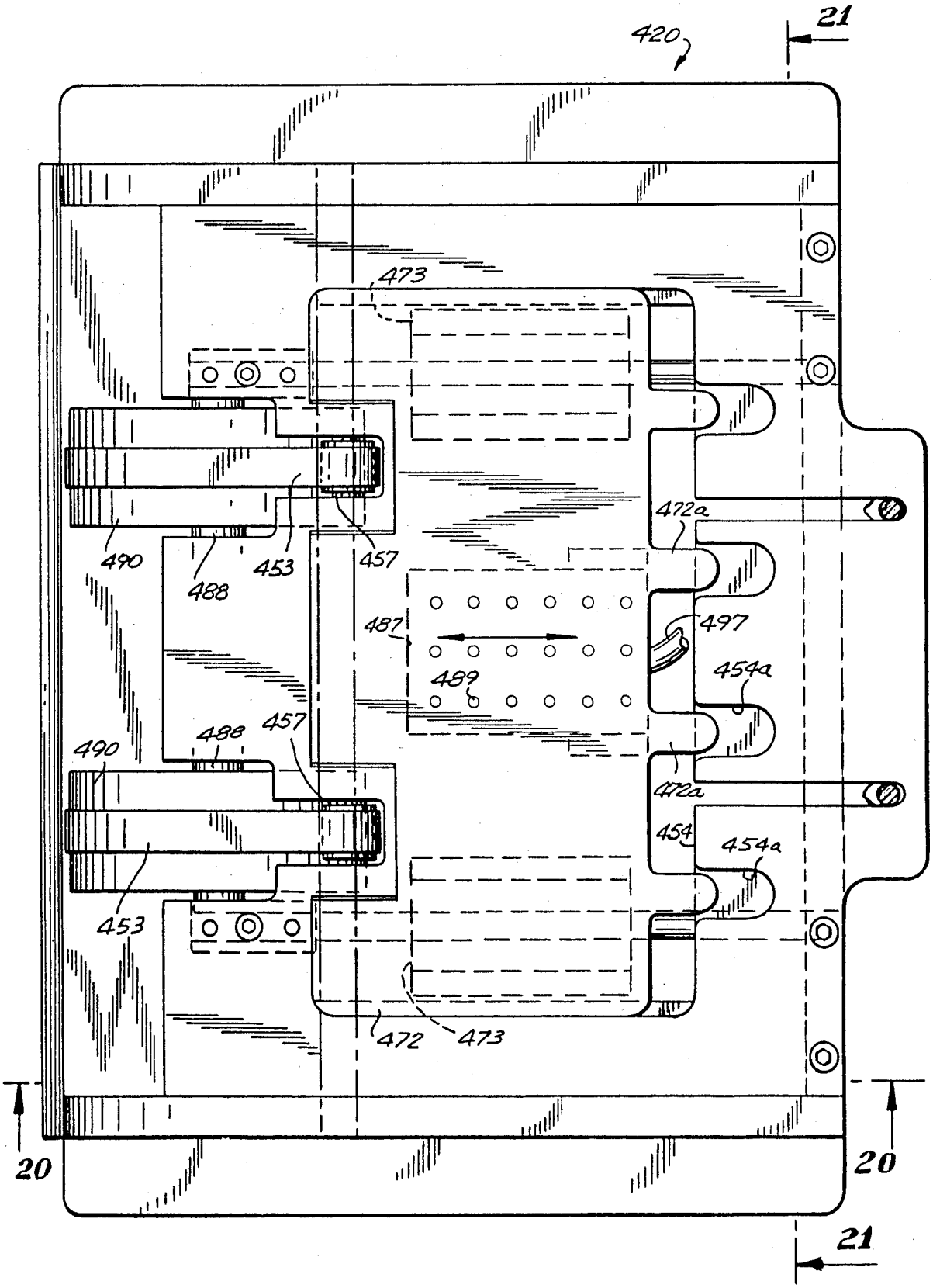
FIG. 19 is a top plan view of a vacuum shuttle plate assembly for removing the lowermost insert from an insert hopper, according to another embodiment of the present invention.
Figure 20:
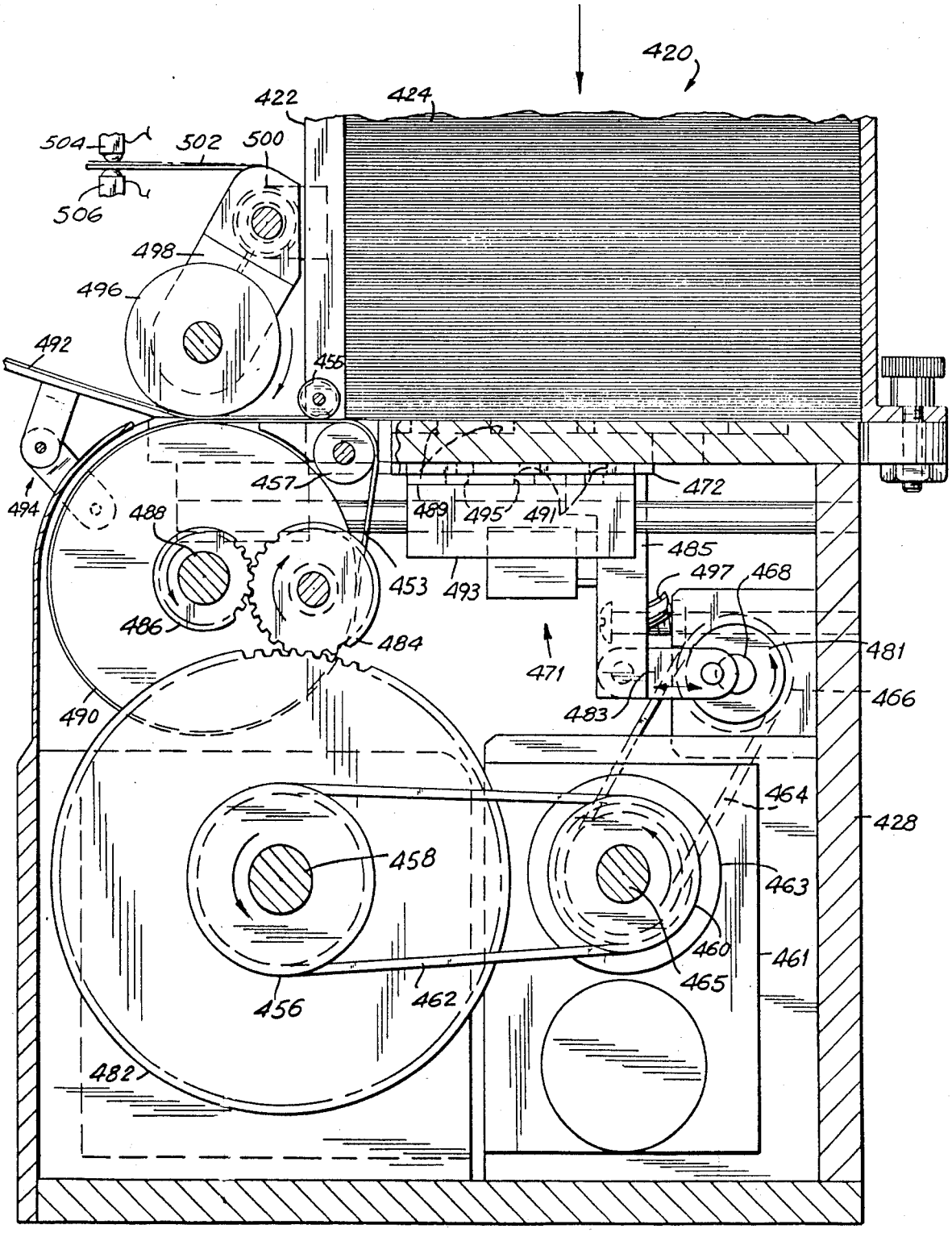
FIG. 20 is a partial cross-sectional view of the vacuum shuttle plate assembly of FIG. 19, taken along line 20—20 thereof.
Figure 21:
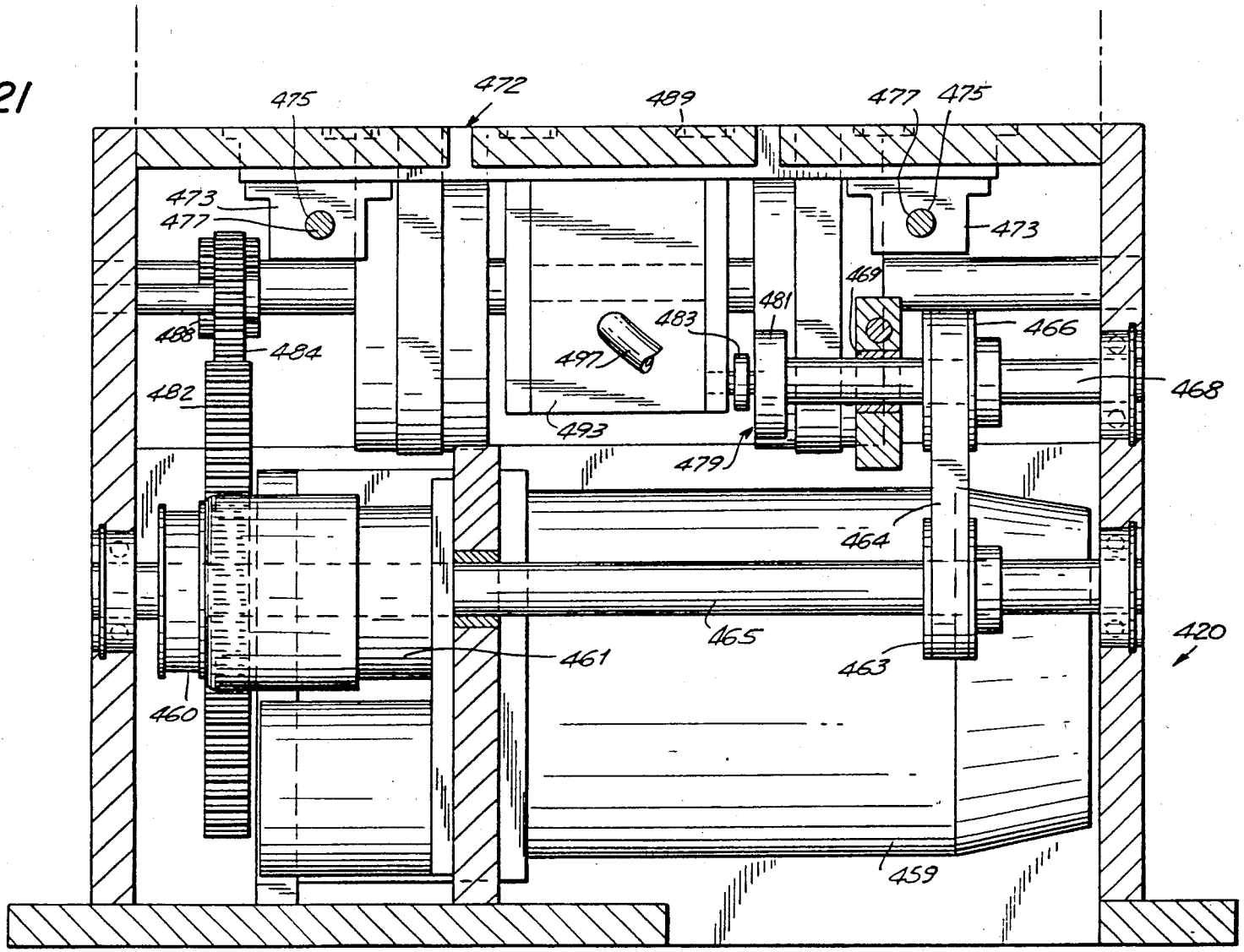
FIG. 21 is a partial cross-sectional view of the vacuum shuttle plate assembly of FIG. 19, taken along line 21—21 thereof.

Referring now to FIGS. 19–21, there is shown another embodiment of mail inserting and collating apparatus 420 according to the present invention, in which elements similar to those of mail inserting and collating apparatus 20 of FIGS. 1–18 are identified by the same numerals, augmented by 400, and a detailed description thereof will be omitted herein for the sake of brevity. As with the embodiment of FIG. 1, a gate (not shown) is used in conjunction with each insert hopper.

As shown, a vacuum shuttle plate assembly 471 is provided in place of kicker roller 72. Vacuum shuttle plate assembly 471 includes a vacuum shuttle plate 472 positioned beneath each insert hopper 422. Specifically, vacuum shuttle plate 472 is mounted on two linear bearing blocks 473 at opposite sides thereof, each linear bearing block having a through bore 475 which receives a guide rod 477 fixedly mounted to the apparatus. In this manner, linear bearing blocks 473, and thereby vacuum shuttle plate 472, can move along guide rods 477 toward and away from the nip between rollers 490 and 496.

For moving shuttle plate 472, the continuously rotating output shaft 458 of a motor 459 has a pulley 456 mounted thereto. A belt 462 is driven by pulley 456 and engages pulley 460 which rotates on shaft 465 through a single revolution clutch 461 such that when the clutch is engaged, shaft 465 has a single rotation. Rotatable with shaft 465 is a pulley 463 which is connected by means of a belt 464 to another pulley 466 which is secured on a shaft 468 rotatably supported by at least one bearing assembly 469. Clutch 461, like all of the other single revolution clutches, is actuated by a signal that detects a pocket in front of a hopper, which detection apparatus (not shown) is conventional.

A slider-crank mechanism 479 provides reciprocal motion of vacuum shuttle plate 472 in response to rotation of shaft 468 via clutch 461. Specifically, slider-crank mechanism 479 includes a crank wheel 481 fixedly secured to shaft 468. A crank rod 483 has one end thereof pivotally secured to crank rod 483 in an eccentric manner, as shown in FIG. 20, and the opposite end thereof is pivotally secured to a connecting rod 485 which, in turn, is secured to vacuum shuttle plate 472.

With this arrangement, as shaft 468 is caused to intermittently rotate via clutch 461, vacuum shuttle plate 472 is caused to reciprocate back and forth, that is, to the left and right of FIG. 20.

Vacuum shuttle plate 472 has a vacuum chamber 487 therein. At least one opening is formed in the top of vacuum shuttle plate 472 in communication with vacuum chamber 487. Preferably, a plurality of upper apertures 489 are provided in the top of vacuum shuttle plate 472 in communication with vacuum chamber 487. The number and location of the apertures will vary depending on the type and size of insert material utilized. A plurality of lower apertures 491 are provided in the bottom of vacuum shuttle plate 472. In addition, as shown in FIG. 19, insert hopper 422 is formed with an opening 454 having a plurality of recessed sections **454*a*. Vacuum shuttle plate 472 is formed with a plurality of projections 472*a* corresponding in position and size to recessed sections 454*a***, thereby minimizing paper jams.

A stationary vacuum release valve 493 is provided immediately below vacuum shuttle plate 472, and the latter slides thereover. As is well known, vacuum release valve 493 includes a plurality of upper apertures 495 in the upper surface thereof which are always in registration with lower apertures 491 of vacuum shuttle plate 472, except when vacuum shuttle plate 472 is in the leftmost reciprocal position of FIG. 20. A vacuum is supplied to vacuum release valve 493 by means of a vacuum line 497 and a vacuum pump (not shown) connected to the opposite end of vacuum line 497.

When vacuum shuttle plate 472 is in its rightmost position of FIG. 20, lower apertures 491 thereof are in registration with upper apertures 495 of vacuum release valve 493. As a result, a vacuum is supplied to upper apertures 489 of vacuum shuttle plate 472 through vacuum line 497, vacuum release valve 493, upper apertures 495 thereof, lower apertures 491, and vacuum chamber 487. Accordingly, the vacuum pulls down a mailing insert 424 from hopper 422, pasts the gate, onto vacuum shuttle plate 472 and holds the same thereon. Thereafter, vacuum shuttle plate 472 is caused to move to the left of FIG. 20. Since the suction is still applied, the lowermost mailing insert 424 is moved therewith. When vacuum shuttle plate 472 is moved to its leftmost position of FIG. 20, lower apertures 491 thereof are out of registration with upper apertures 495 of vacuum release valve 493. As a result, the vacuum is cut off, and the mailing insert thereon is no longer held by such vacuum.

When the vacuum is cut off, the forward edge of such mailing insert 424 has been moved between the nip of rollers 455 and 457, the latter being driven through a belt 453 by roller 490. Accordingly, rollers 455 and 457 move the insert 424 to the nip between rollers 490 and 494, which thereafter move the insert onto ramp 492 and then into a respective pocket.

Figure 22:
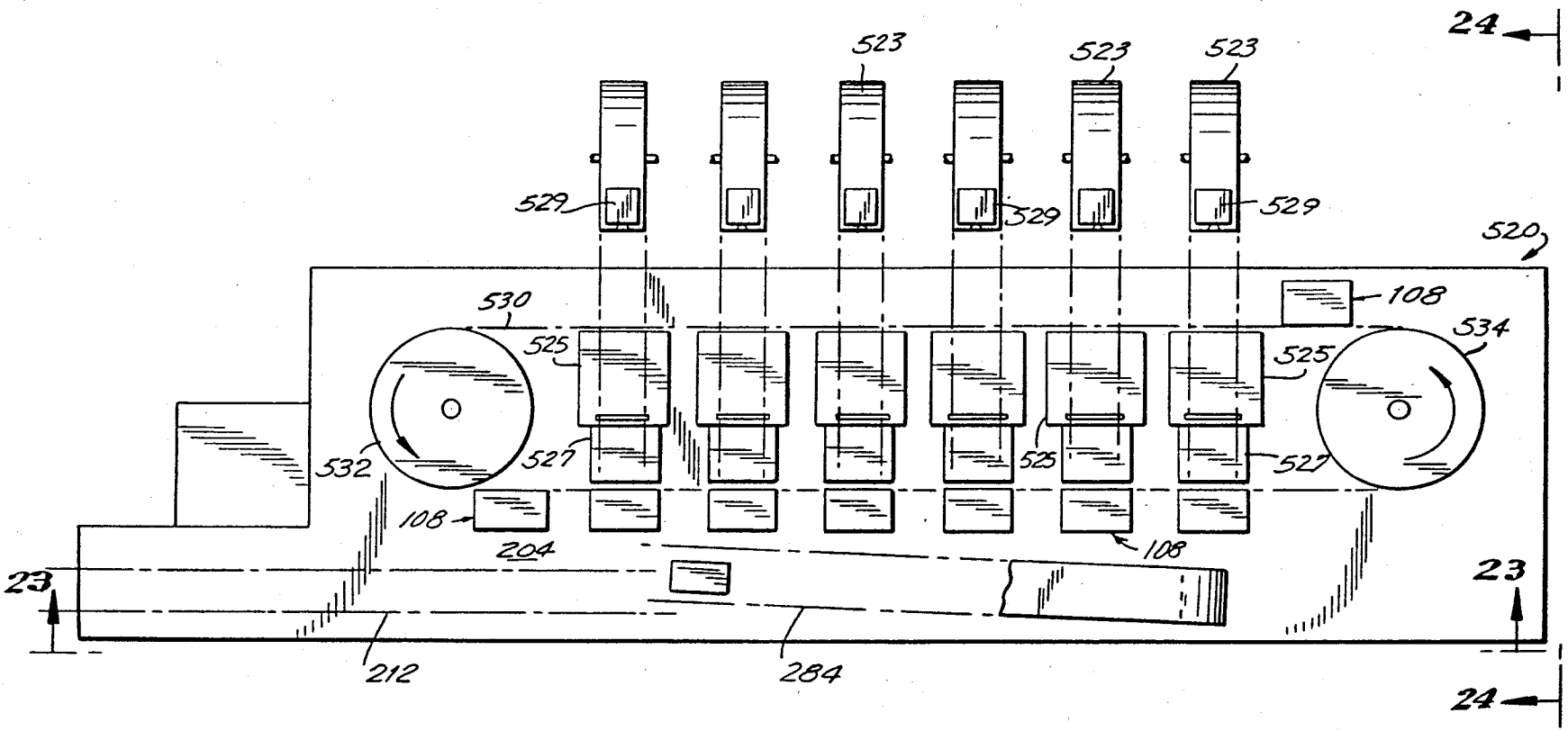
FIG. 22 is a top plan view of mail inserting and collating apparatus according to another embodiment of the present invention.
Figure 23:
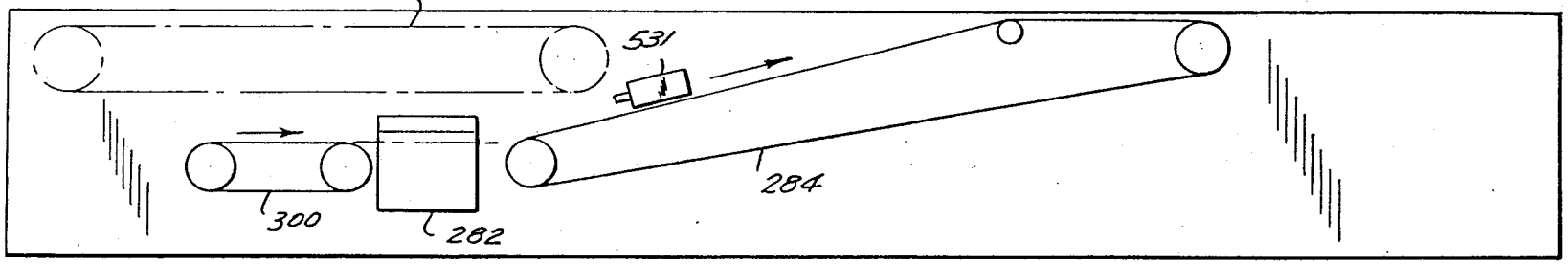
FIG. 23 is a side elevational view of the mail inserting and collating apparatus of FIG. 22.
Figure 24:
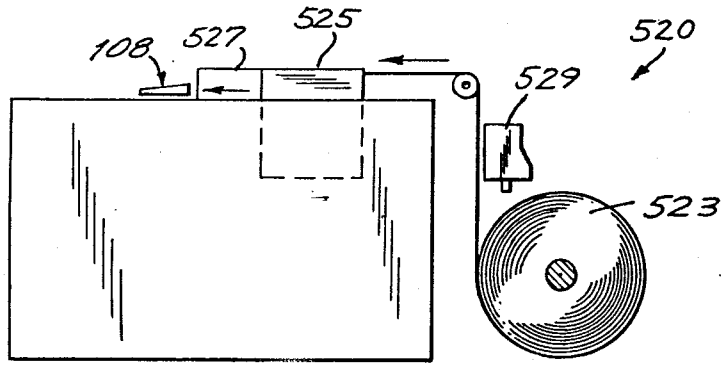
FIG. 24 is an end elevational view of the mail inserting and collating apparatus of FIG. 22.

Referring now to FIGS. 22–24, there is shown a further embodiment of mail inserting and collating apparatus 520 according to the present invention, in which elements similar to those of the embodiment of FIGS. 1-18 are identified by the same reference numerals, augmented by 500, and a detailed description of such like elements will be omitted herein for the sake of brevity.

As shown, in place of insert hoppers 22, the inserts are formed from webs of paper. Specifically, a plurality of webs or rolls 523 of paper are mounted in a line parallel to an imaginary line connecting sprockets 532 and 534, and outside of the area bounded by insert conveyor 530. A line of paper cutters 525 are connected in line with respective ones of the webs 523, and within the area bounded by insert conveyor 530. A plurality of folding devices 527 are connected in line with respective ones of the paper cutters 525 and adjacent thereto. Thus, the paper from webs 523 are supplied to paper cutters 525 which cut the web into a plurality of individual sheets. The individual sheets are then supplied to folding devices 527, which fold the sheets to form the inserts, and supply the same to pockets 108, as the latter pass by. The webs 523 may be pre-printed, or alternatively or in addition, an ink jet head 529 can be positioned above the paper extending from a web 523 to a respective paper cutter 525, to print thereon.

Thus, pockets 108 pick up the inserts as they travel by each folding device 527. When the pocket 108 travels around to the insert and envelope merge station 204 shown in FIG. 22, the inserts are inserted into an envelope on envelope conveyor 212. The envelope is then brought to postage meter 282 or conveyor 300, as described in the embodiment of FIGS. 1–18. If the envelope is brought to postage meter 282, it is then deposited on output conveyor assembly 284. In conjunction therewith, an ink jet head 531 can be provided immediately above output conveyor assembly 284 for printing, for example, an address on the envelope.

Referring now to FIGS. 25–29, there is shown a further embodiment of mail inserting and collating apparatus 620 according to the present invention, in which elements similar to those of the embodiment of FIGS. 19–21 are identified by the same reference numerals, augmented by 200, and a detailed description of such like elements will be omitted herein for the sake of brevity. Mail inserting and collating apparatus 620 is formed in an in-line arrangement, that is, in which the direction of removal of the envelopes from the envelope hopper is the same as the direction of movement of the envelope conveyor. In addition, each insert hopper is formed with a gate 23 as in the embodiment of FIG. 1.

As shown, a vacuum shuttle plate 672 is associated with the envelope hopper and which is substantially identical to vacuum shuttle plate 472 associated with each insert hopper. Thus, a drive assembly 651 includes a drive motor for continuously driving a shaft 658. Specifically, the output shaft 658 of motor 659 drives pulley 656 continuously and via belt 662 a pulley 660. Pulley 660 rotates on shaft 665 through a single revolution clutch 661 so that when clutch 661 is engaged, shaft 665 has a single rotation. Rotatable with shaft 665 is a pulley 660 which via belt 664 is connected to a pulley 681 which is mounted on shaft 668, whereby shaft 668 is intermittently rotated.

Figure 25:
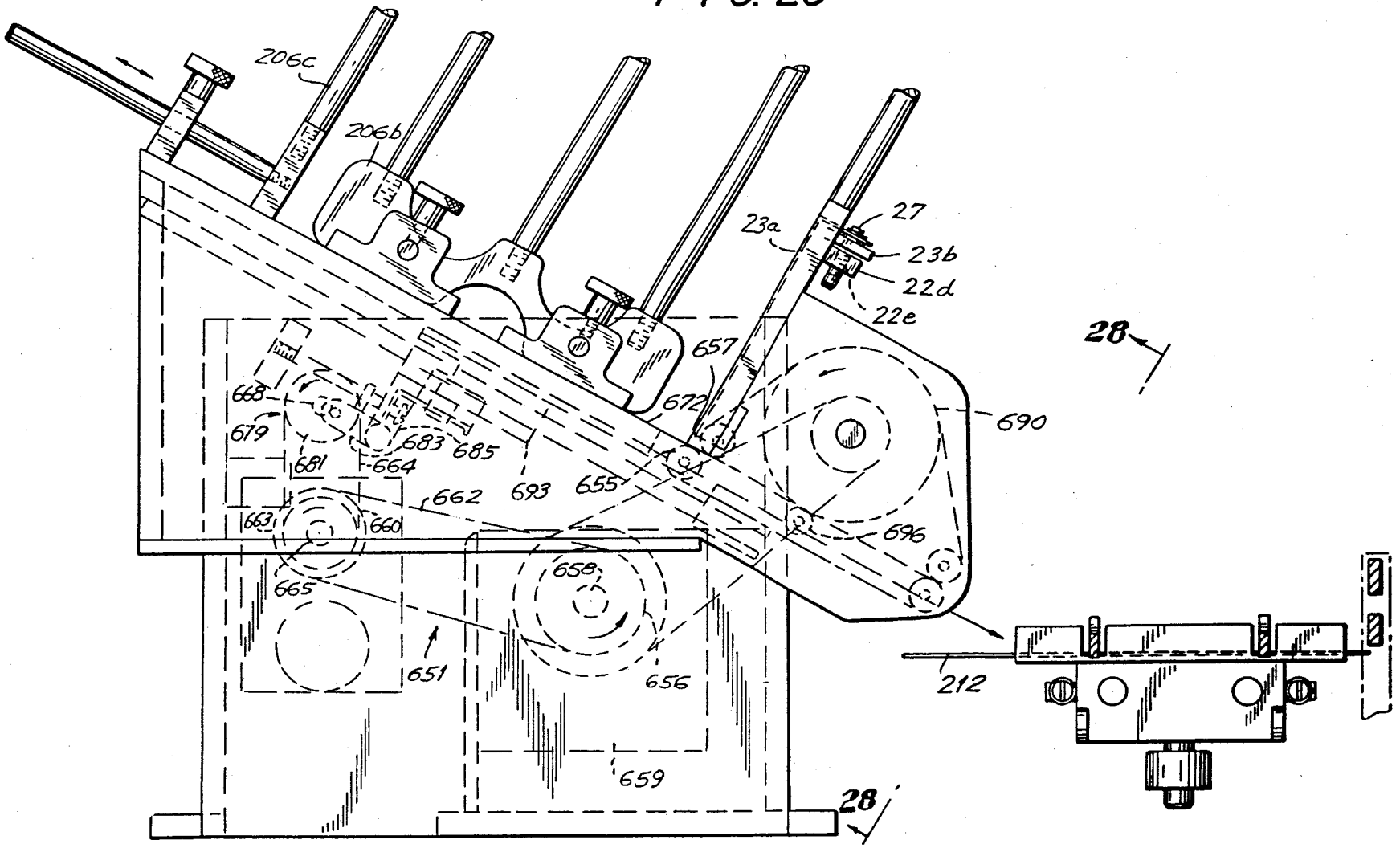
FIG. 25 is a side elevational view of a vacuum shuttle plate assembly for removing the lowermost envelope from the envelope hopper, according to another embodiment of the present invention.
Figure 26:
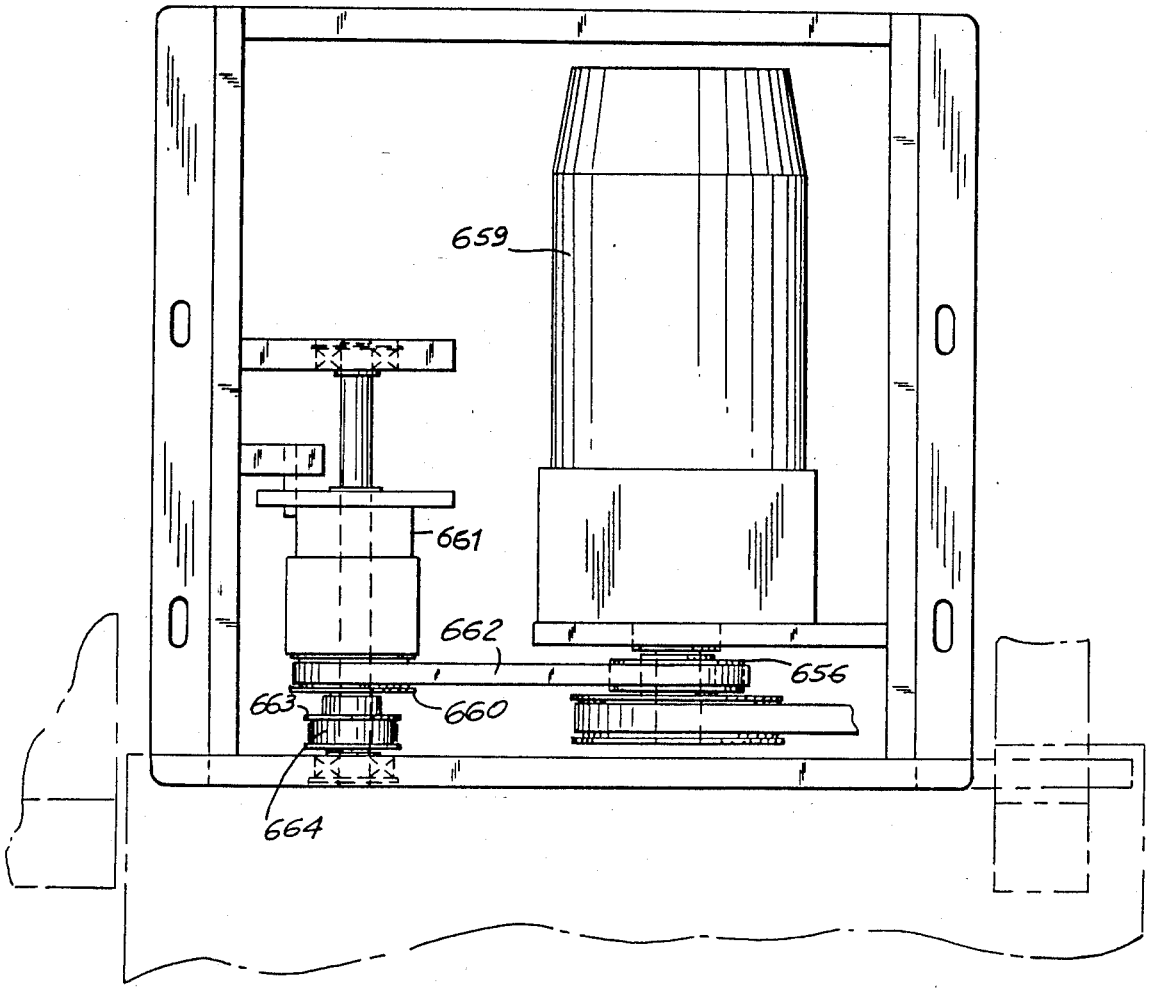
FIG. 26 is a bottom plan view of the drive assembly for the vacuum shuttle plate assembly of FIG. 25.

A slider-crank mechanism 679, which is substantially identical to slider-crank mechanism 479 of FIGS. 19–21, is driven by drive assembly 651 and, in turn, causes vacuum shuttle plate 672 to reciprocate. Slider-crank mechanism 679 thereby includes a crank wheel 681 fixedly secured to shaft 668. A crank rod 683 has one end thereof pivotally secured to crank rod 683 in an eccentric manner, as shown in FIG. 25, and the opposite end thereof is pivotally secured to a connecting rod 685 which, in turn, is secured to vacuum shuttle plate 672. With this arrangement, as shaft 668 is caused to intermittently rotate, vacuum shuttle plate 672 is caused to reciprocate back and forth, that is, to the left and right of FIG. 25.

A vacuum release valve 693 is also provided, which is substantially identical to vacuum release valve 493. Thus, vacuum shuttle plate 672 is supplied with a vacuum from vacuum release valve 693 at all positions, except its rightmost position, as viewed from FIG. 25. Thus, vacuum shuttle plate 672 provides suction to an envelope to carry the envelope with it in response to slider-crank mechanism 679, to the right of FIG. 25. When vacuum shuttle plate 672 reaches its rightmost position of FIG. 25, the vacuum is cut off. Thereby, during the leftward return travel of vacuum shuttle plate 672, the envelope is not returned therewith.

When the vacuum is released at the rightmost position, the envelope is gripped between the nip of rollers 655 and 657, and then between the nip of rollers 690 and 696, and then onto envelope conveyor 212. Rollers 657 and 690 are driven by a series of pulleys and belts by output shaft 658 from motor 659.

Figure 27:
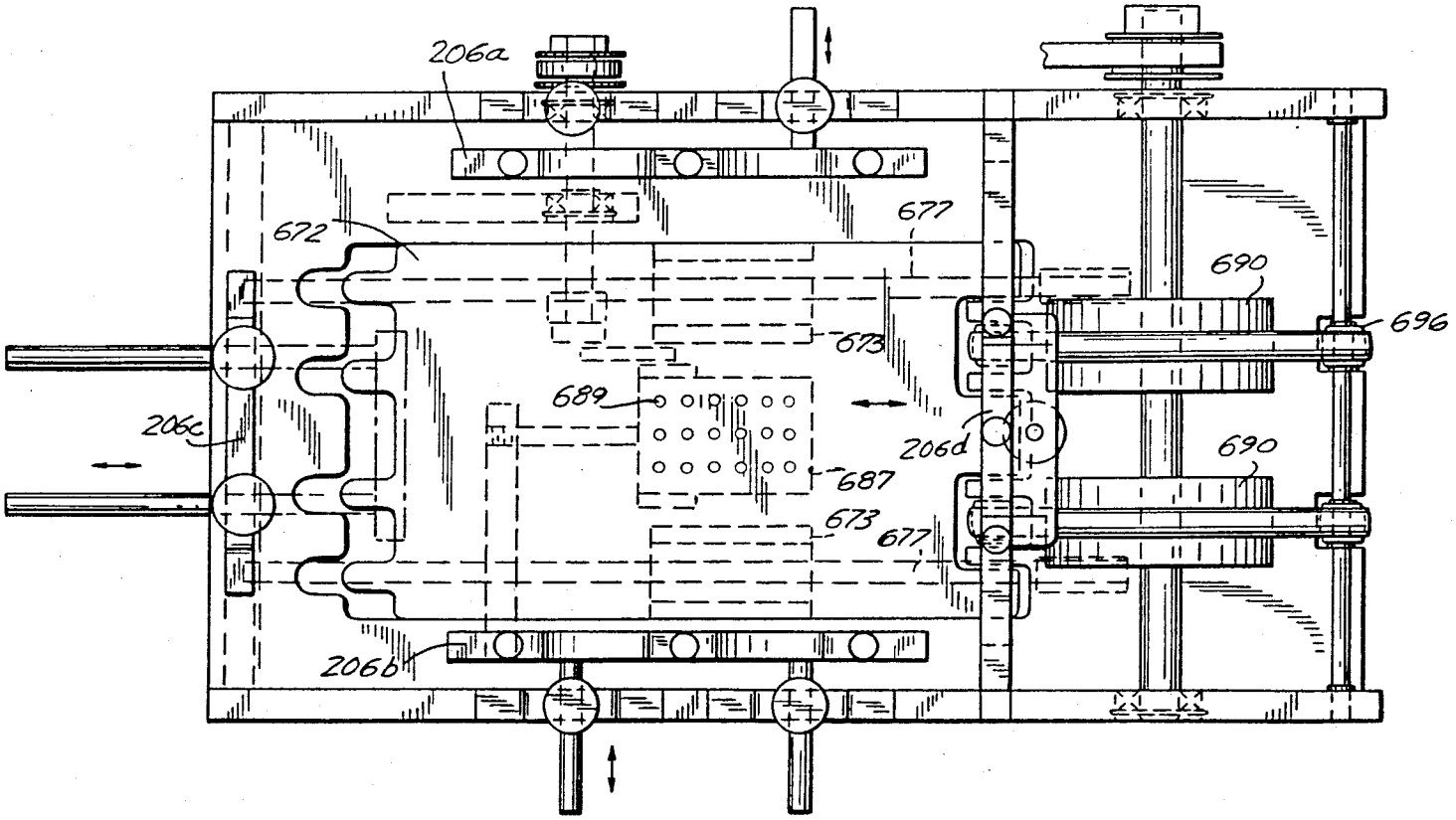
FIG. 27 is a top plan view of the vacuum shuttle plate assembly of FIG. 25.
Figure 28:
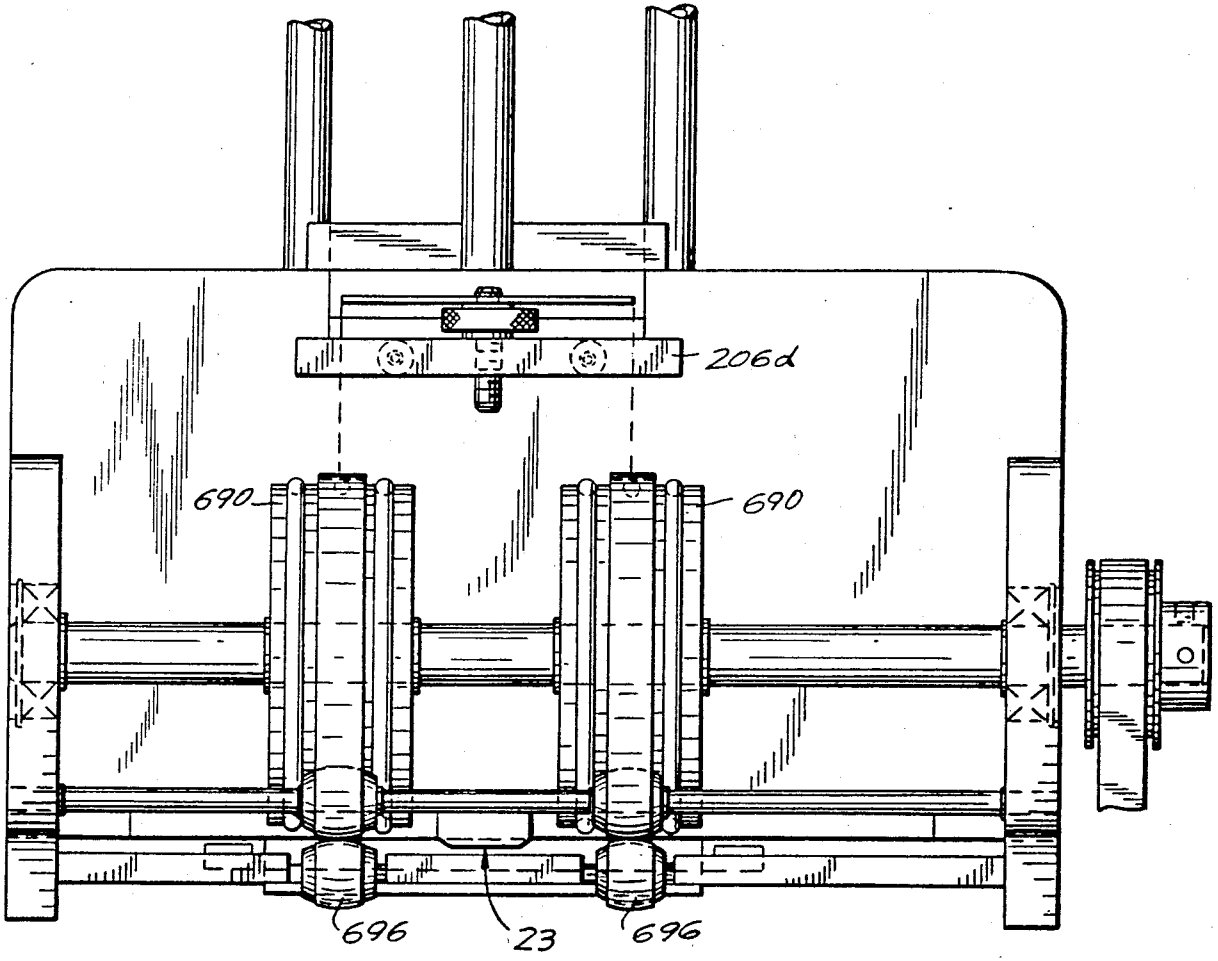
FIG. 28 is an end elevational view of the vacuum shuttle plate assembly of FIG. 25, viewed from line 28—28 thereof.

As also shown in FIGS. 25 and 27, envelope hopper 206 is bounded by four plates **206*a*, 206*b*, 206*c* and 206*d***, each being adjustably movable to vary the size of the hopper for different sized envelopes.

Figure 29:
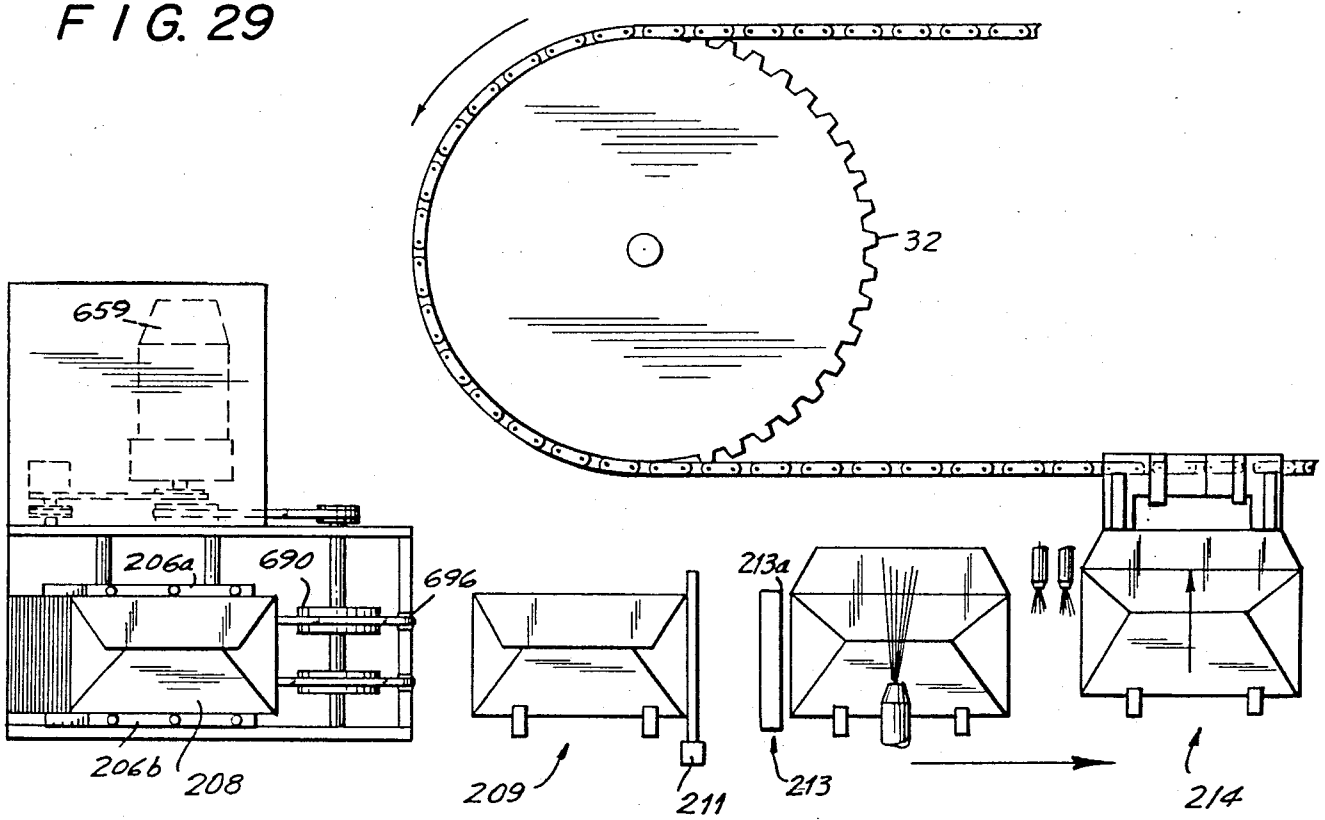
FIG. 29 is a top plan view of a portion of an in-line mail inserting and collating apparatus according to the present invention.

As shown in FIG. 29, unlike the off-line embodiment of FIG. 1, envelopes 208 have their flaps closed in envelope hopper 206 and at station 209 are transported to the envelope carrier. Thus, there is also provided a flap opening station 213, at which a flap opening device **213*a*** is provided, which is conventional in the art, is schematically shown.

With all of the above embodiments, it is noted that the different elements thereof are modular, that is, they can be separately assembled and disassembled very easily and quickly. Thus, for example, the insert hoppers can be set up off-line.

Having described a specific preferred embodiment of the invention with reference to the accompanying drawings, it will be appreciated that the present invention is not limited to that precise embodiment, and that various changes and modifications can be effected therein by one of ordinary skill in the art without departing from the spirit or scope of the invention as defined by the appended claims.

What is claimed is:

1. Mail inserting and collating apparatus comprising:

envelope conveyor means for continuously conveying a plurality of envelopes along a first path;

at least one envelope carrier means mounted on said envelope conveyor means and movable therewith, for holding said envelopes on said envelope conveyor means;

insert conveyor means for continuously conveying a plurality of inserts along a second path, at least a portion of said second path running substantially parallel and adjacent to said first path;

at least one adjustable length pocket means mounted on said insert conveyor means and movable therewith, for holding said inserts on said insert conveyor means;

cam means for moving each envelope carrier means toward a respective pocket means at an insert and envelope merge station;

means for reducing the length of each pocket means as it approaches said merge station while said pockets are moving to allow said envelopes to move over said pocket means; and vacuum shuttle plate means for removing a lowermost insert from a stack of inserts and moving said lowermost insert toward a respective pocket means positioned adjacent said stack, said vacuum shuttle plate means including a vacuum shuttle plate having vacuum apertures on an upper surface thereof for providing a suction to the lowermost insert from said stack;

means for reciprocating said vacuum shuttle plate between a first position and a second position; and vacuum means for supplying a vacuum to said vacuum apertures of said vacuum shuttle plate when said vacuum shuttle plate is reciprocated to said first position and for removing said vacuum when said vacuum shuttle plate is reciprocated to said second position.

2. Mail inserting and collating apparatus according to claim 1; wherein said means for reciprocating includes:

slider-crank means for reciprocating said vacuum shuttle plate; and drive means for driving said slider-crank means.

3. Mail inserting and collating apparatus according to claim 1; wherein said vacuum shuttle plate further includes vacuum apertures on a lower surface thereof and a vacuum chamber in fluid communication between said lower and upper apertures, and said vacuum means includes vacuum release valve means positioned below said vacuum shuttle plate for supplying said vacuum to said vacuum chamber through said lower apertures and vacuum supply means for supplying a vacuum to said vacuum release valve means.

4. Mail inserting and collating apparatus according to claim 3; wherein said vacuum release valve means includes upper apertures in fluid communication with said lower apertures of said vacuum shuttle plate when said vacuum shuttle plate is in said first position and out of fluid communication with said lower apertures of said vacuum shuttle plate when said vacuum shuttle plate is in said second position.

5. Mail inserting and collating apparatus comprising:

envelope conveyor means for continuously conveying a plurality of envelopes along a first path;

at least one envelope carrier means mounted on said envelope conveyor means and movable therewith, for holding said envelopes on said envelope conveyor means;

insert conveyor means for continuously conveying a plurality of inserts along a second path, at least a portion of said second path running substantially parallel and adjacent to said first path;

at least one adjustable pocket means mounted on said insert conveyor means and movable therewith, for holding said inserts on said insert conveyor means;

cam means for moving each envelope carrier means toward a respective pocket means at an insert and envelope merge station;

means for reducing the length of each pocket means as it approaches said merge station while said pockets are moving to allow said envelopes to move over said pocket means; and vacuum shuttle plate means for removing a lowermost envelope from a stack of envelopes and moving said lowermost envelope toward said envelope conveyor means positioned adjacent said stack, said vacuum shuttle plate means including a vacuum shuttle plate having vacuum apertures on an upper surface thereof for providing a suction to the lowermost envelope from said stack;

means for reciprocating said vacuum shuttle plate between a first position and a second position; and vacuum means for supplying a vacuum to said vacuum apertures of said vacuum shuttle plate when said vacuum shuttle plate is reciprocated to said first position and for removing said vacuum when said vacuum shuttle plate is reciprocated to said second position.

6. Mail inserting and collating apparatus according to claim 5; wherein said means for reciprocating includes:

slider-crank means for reciprocating said vacuum shuttle plate; and drive means for driving said slider-crank means.

7. Mail inserting and collating apparatus according to claim 5; wherein said vacuum shuttle plate further includes vacuum apertures on a lower surface thereof and a vacuum chamber in fluid communication between said lower and upper apertures, and said vacuum means includes vacuum release valve means positioned below said vacuum shuttle plate for supplying said vacuum to said vacuum chamber through said lower apertures and vacuum supply means for supplying a vacuum to said vacuum release valve means.

8. Mail inserting and collating apparatus according to claim 7; wherein said vacuum release valve means includes upper apertures in fluid communication with said lower apertures of said vacuum shuttle plate when said vacuum shuttle plate is in said first position and out of fluid communication with said lower apertures of said vacuum shuttle plate when said vacuum shuttle plate is in said second position.

* * * * *